US010711976B2

(12) United States Patent
Di Trapani et al.

(10) Patent No.: US 10,711,976 B2
(45) Date of Patent: Jul. 14, 2020

(54) LIGHTING SYSTEM WITH APPEARANCE AFFECTING OPTICAL SYSTEM

(71) Applicant: COELUX S.R.L., Lomazzo (IT)

(72) Inventors: Paolo Di Trapani, Cavallasca (IT); Davide Magatti, Capiago Intimiano (IT); Antonio Lotti, Arcisate (IT); Matteo Molteni, Cassina Rizzardi (IT); Giorgio Gatti, Lurate Caccivio (IT)

(73) Assignee: CoeLux S.r.l., Lomazzo (CO) (IT)

( * ) Notice: Subject to any disclaimer, the term of this patent is extended or adjusted under 35 U.S.C. 154(b) by 0 days.

(21) Appl. No.: 16/348,627

(22) PCT Filed: Nov. 19, 2016

(86) PCT No.: PCT/EP2016/001944

§ 371 (c)(1),
(2) Date: May 9, 2019

(87) PCT Pub. No.: WO2018/091060

PCT Pub. Date: May 24, 2018

(65) Prior Publication Data

US 2019/0360661 A1 Nov. 28, 2019

(51) Int. Cl.
*F21V 9/02* (2018.01)
*F21V 9/20* (2018.01)
(Continued)

(52) U.S. Cl.
CPC ..... *F21V 9/02* (2013.01); *F21S 8/026* (2013.01); *F21V 3/02* (2013.01); *F21V 7/04* (2013.01); *F21V 9/20* (2018.02); *F21V 11/02* (2013.01)

(58) Field of Classification Search
CPC ... F21V 11/02; F21V 7/04; F21V 3/02; F21V 9/20; F21V 13/02; F21V 11/06; F21S 8/026
See application file for complete search history.

(56) References Cited

U.S. PATENT DOCUMENTS

2012/0140436 A1* 6/2012 Yang ..... F21V 13/02 362/84
2014/0160720 A1 6/2014 Seuntiens et al.
(Continued)

FOREIGN PATENT DOCUMENTS

EP 2918901 A1 9/2015
WO 2009156347 A1 12/2009
(Continued)

OTHER PUBLICATIONS

Remko Dinkla, European International Searching Authority, International Search Report and Written Opinion, corresponding PCT Application No. PCT/EP2016/001944, dated Feb. 14, 2017, 10 pages total.

(Continued)

*Primary Examiner* — Kevin Quaterman
(74) *Attorney, Agent, or Firm* — DiBerardino McGovern IP Group LLC

(57) ABSTRACT

In an aspect, a lighting system (1) comprises a lighting unit (11) with a light source (31) and a dichroic light exiting surface (15), wherein the lighting unit (11) is configured for emitting dichroic light from the dichroic light exiting surface (15). The emitted dichroic light includes a directional light portion (37) of direct light (17) and a diffused light portion (39) of diffused light (19) with a another larger correlated color temperature. The lighting system further comprises an appearance affecting optical system (13) with a plurality of structural elements (40, 91, 93, 101, 105) that comprise surfaces that delimit a plurality of diffused light passages (14, 103, 107), and comprise direct light illuminated surface regions (25), which are subject to the illumination with direct light (17) from respectively associated affected direct light providing areas (81) of the dichroic light exiting surface (15). Moreover, the affected direct light providing areas (81) cover at least 70% of the dichroic light exiting (Continued)

surface (15), and the direct light (17) from at least one affected direct light providing area (81) and diffused light (19) propagate within at least one of the diffused light passages (14, 103, 107).

25 Claims, 13 Drawing Sheets

(51) Int. Cl.

| | |
|---|---|
| ***F21S 8/02*** | (2006.01) |
| ***F21V 3/02*** | (2006.01) |
| ***F21V 7/04*** | (2006.01) |
| ***F21V 11/02*** | (2006.01) |

(56) References Cited

U.S. PATENT DOCUMENTS

| | | | | |
|---|---|---|---|---|
| 2015/0316231 | A1* | 11/2015 | Di Trapani | F21V 9/02 362/147 |
| 2015/0316232 | A1 | 11/2015 | Di Trapani et al. | |
| 2018/0335188 | A1 | 11/2018 | Di Trapani et al. | |
| 2018/0363860 | A1* | 12/2018 | Kasugai | F21K 9/64 |
| 2019/0285247 | A1 | 9/2019 | Nanot et al. | |

FOREIGN PATENT DOCUMENTS

| | | | |
|---|---|---|---|
| WO | 2009156348 | A1 | 12/2009 |
| WO | 2014075721 | A1 | 5/2014 |
| WO | 2014076656 | A1 | 5/2014 |
| WO | 2015172794 | A1 | 11/2015 |
| WO | 2015172821 | A1 | 11/2015 |
| WO | 2017036502 | A1 | 3/2017 |

OTHER PUBLICATIONS

T.C. Grenfell et al., "Representation of a non-spherical ice particle by a collection of independent spheres for scattering and absorption of radiation," Journal of Geophysical Research, vol. 104, No. D24, pp. 31,697-31,709 (13 total pages), Dec. 27, 1999.

* cited by examiner

LIGHTING SYSTEM WITH APPEARANCE AFFECTING OPTICAL SYSTEM

TECHNICAL FIELD

The present disclosure relates generally to lighting systems, in particular to lighting systems for optically providing a widened perception/impression of the ambient space and in particular for imitating natural sunlight illumination. Moreover, the present disclosure relates generally to implementing such a lighting system, for example, in an indoor room.

BACKGROUND

Artificial lighting systems for closed environments often aim at improving the visual comfort experienced by users. For example, lighting units are known for simulating natural lighting, specifically sunlight illumination, that provide dichroic light to be emitted from a dichroic light exiting surface, where the dichroic light comprises a directional light portion of direct light having a first correlated color temperature (CCT) and a diffused light portion of diffused light having a second CCT. The direct light radiates essentially along a local main direction, wherein the local main direction corresponds to a luminous intensity peak in the angular luminous intensity distribution of the direct light emitted at a specific location of the light exiting surface. In other words, inter alia local main direct light rays originate from specific locations in respective local main direction. In contrast, the diffused light has in particular for natural lighting imitation a second correlated color temperature, which is larger than the first correlated color temperature. That sky imitating light radiates with a local Lambertian-like angular luminous intensity distribution from specific locations of the light exiting surface.

Exemplary embodiments of such lighting systems using, for example, Rayleigh-like diffusing layers are disclosed in several applications such as WO 2009/156347 A1, WO 2009/156348 A1, WO 2014/076656 A1, and WO 2015/172821 A1 filed by the same applicants. The disclosed lighting systems use a light source producing visible light, and a panel containing nanoparticles used in transmission or reflection. During operation of those lighting systems, the panel receives the light from the light source and acts as a so-called Rayleigh diffuser, namely it diffuses incident light similarly to the earth atmosphere in clear-sky conditions. Specifically, the disclosed concepts refer to directional light with lower correlated color temperature (CCT), which corresponds to sunlight, and diffuse light with larger CCT, which corresponds to the light of the blue sky.

In further embodiments such as those disclosed in WO 2014/075721 A1, the un-published international patent application PCT/EP2015/077169, and the not yet published international patent application PCT/EP2015/069790 filed by the same applicants on 28 Aug. 2016, the concepts of direct light with lower CCT and diffused light with larger CCT are implemented in a linear configuration and in a compact setup using e.g. a one-dimensionally curved mirror and light guide configuration, respectively. It is noted that WO 2014/075721 A1 discloses further a coffered ceiling structure that is used to mask modulations within the artificial sky, while maintaining direct "sunlight" illumination.

The contents of the above mentioned disclosures are incorporated herein by reference.

To provide for a sun-like impression, the light sources may be designed for a sun-like perception such as disclosed in WO 2015/172794 A1 filed by the same applicants. As disclosed therein, a detailed analysis and a plurality of optical measures were implemented to achieve the desired sun-like perception of the aperture of the light source.

The herein disclosed concepts are in particular directed at providing lighting systems that can achieve similarly the simulation of natural lighting, specifically sunlight illumination, but have reduced requirements of the perceptive features of the light source.

Thus, the present disclosure is directed, at least in part, to improving or overcoming one or more aspects of prior systems.

SUMMARY OF THE DISCLOSURE

In a first aspect, the present disclosure is directed to a lighting system with a lighting unit with a light source and a dichroic light exiting surface, wherein the lighting unit is configured for emitting dichroic light from the dichroic light exiting surface and the emitted dichroic light includes a directional light portion of direct light with a first correlated color temperature, wherein the direct light from a specific location of the dichroic light exiting surface is emitted with a directed angular luminous intensity distribution with a local peak, which defines a local main direction of direct light emitted from that specific location, and a diffused light portion of diffused light with a second correlated color temperature, which is larger than the first correlated color temperature, wherein the diffused light is emitted for a specific location of the dichroic light exiting surface, with a diffuse angular luminous intensity distribution. The lighting system further comprises an appearance affecting optical system with an entrance side located at the side of the dichroic light exiting surface, an exit side opposite to the entrance side, and a plurality of structural elements that comprise surfaces that extend in-between the entrance side and the exit side, delimit a plurality of diffused light passages, and comprise direct light illuminated surface regions, which are subject to the illumination with direct light from respectively associated affected direct light providing areas of dichroic light exiting surface. Moreover, the lighting system is configured such that the affected direct light providing areas cover at least 70% of the dichroic light exiting surface, and the direct light from at least one affected direct light providing area and diffused light propagate within at least one of the diffused light passages.

In some embodiments of the lighting system, the lighting unit may comprise further a light source for emitting light with a directed luminous intensity profile, a collimating and/or folding optics for guiding the light from the light source, and a diffuser unit that is illuminated by the light source, wherein an output side of diffuser unit forms the dichroic light exiting surface of lighting unit.

At least one of the diffused light passages may be configured such that some of the direct light passes from unaffected direct light providing areas of the light exiting surface to the exit side without interacting with any structural element and wherein the unaffected direct light providing areas in particular may cover up to 30% of the area of the dichroic light exiting surface. At least one of the diffused light passages may be configured as a void volume that allows looking at a portion of the light exiting surface under a light passage specific range of observation angles and seeing diffused light propagating through the light passage, some of which passing from the dichroic light exiting surface to the exit side without interacting with any structural element, wherein at least one of the diffused light passages is at least partially delimited by respective direct light illuminated surface regions.

The direct light emitted from a specific location of the dichroic light exiting surface may comprise a local main direct light ray that originates from that specific location in the local main direction and the relation between a direct light illuminated surface region and an associated affected direct light providing area may be given by the condition that those locations on the dichroic light exiting surface form the associated affected direct light providing area from which local main direct light rays, which originate in the respective local main directions, propagate through the void of a respective diffused light passages until they impinge, as a first optical interaction, onto the structural element on which the respective direct light illuminated surface region is formed.

The directed angular luminous intensity distribution associated with a specific location of the dichroic light exiting surface may have a full width half maximum that is about or smaller than 40°, 30°, or even 20°. The diffuse angular luminous intensity distribution at a second correlated color temperature is a Lambertian or Lambertian-like intensity distribution.

The structural elements, and in particular the direct light illuminated surface regions, may each extend within a local depth range defined in a normal direction with respect to a dichroic light exiting surface and lateral width range defined in a parallel direction with respect to a dichroic light exiting surface such that at least 60%, such as 70% and more or 80% and more of the radiant flux of the directional light portion is incident on direct light illuminated surface regions. In particular the remaining part of the directional light portion, which is not incident on direct light illuminated surface regions, may be spatially distributed over the dichroic light exiting surface in a plurality of non-contiguous regions.

The dichroic light exiting surface may comprise at least one unaffected direct light providing area from which a local main direct light ray that originates from a specific location in the local main direction, passes through the appearance affecting optical system without interacting with any structural element. The dichroic light exiting surface may comprise at least one diffused light area from which some diffused light passes through the appearance affecting optical system without interacting with any structural element.

At the most 40%, such as 30% or less, for example 20% or less, of the radiant flux of the direct light may pass through the appearance affecting optical system without interacting with any structural element by in particular passing through the respective diffused light passages and/or through an opening within a structural element.

At least one side surface of at least one structural element, in particular the orientation and the shape of a direct light illuminated surface region, may be configured as a reflective side face that guides at least a portion of the dichroic light via at least one reflection from the entrance side to the exit side, and wherein optionally the reflective side face may be configured to reflect at least 60%, such as at least 70%, or even at least 80% of the radiant flux of the directional light portion. A local main direct light ray, which originates from a specific location within an associated affected direct light providing area in the respective local main direction, may perform at least one reflection at at least one reflective side face such that the local main direct light ray is redirected at least once before exiting the appearance affecting optical system at the exit side. The reflective side face may be configured to have a diffusive property to provide for a quasi-specular reflection, in particular to reflect a light beam such that the angular content is enlarged, and in particular that the perception of the light beam is spread in size compared to a pure specular reflection.

The reflective side face may be configured to have a diffusive property when reflecting light such that an output directed angular luminous intensity distribution of the direct light after the diffusive reflection broadens with respect to an input directed angular luminous intensity distribution, wherein the feature of a local peak, which defines a reflected local main direction of direct light reflected from a specific location, may be maintained and wherein in particular the reflective side face may reflect light in a manner that provides a reflected luminous intensity along a reflected main light beam direction that is greater than a reflected luminous intensity of a Lambertian diffuser in that reflected local main light beam direction.

The reflective side face may have a surface shape that reflects local main direct light into a cone of light rays around a specular reflected mean direct light direction, in particular may have a surface of corrugated or etched metal, plastic or glass. Optionally at least one of the degrees of diffusing may be configured to overlap illumination from lighting system arranged next to each other to obtain a uniform illuminance, for example over a grid with one illumination system every 2.5 m.

At least one structural element may be configured to have a diffusive property on transmitted light, at least in the material associated with the direct light illuminated surface region and/or its surface, thereby providing for a diffuse transmission. At least one structural element may be configured to have a diffusive property when transmitting light such that an output directed angular luminous intensity distribution of the direct light after the diffusive transmission broadens with respect to an input directed angular luminous intensity distribution, wherein the feature of a local peak, which defines a transmitted local main direction of direct light transmitted through a specific location, may be maintained and wherein in particular a material portion associated with the direct light illuminated surface region diffusely transmits light by providing a transmitted luminous intensity in a transmitted local main light beam direction that is greater than a transmitted luminous intensity of a Lambertian transmitter in that transmitted local main light beam direction.

At least one structural element may be configured to have a diffusive property in transmission and reflection such that at least a small portion of at least 5% such as 10% of the radiant flux of the directional light portion may be diffuse transmitted or reflected and the remaining portion is respectively reflected or transmitted, and. In particular the small portion is less broadened in its directed angular luminous intensity distribution than the remaining portion, for example to a full width half maximum of about 10° for the small portion and about 60° for the remaining portion.

In some embodiments, the local main direct direction may be constant over the dichroic light exiting surface or may vary over the dichroic light exiting surface within an angular range of about or less than 50°, such as less than or about 30°

In some embodiments, at least one structural element may be planar or curved, lamella, and optionally the plurality of structural elements may be configured as a sequence of lamellae, being in particular identically in size and orientation or vary in size and orientation and/or as a grid structure extending across the dichroic light exiting surface. Moreover, at least one structural element may be configured as a hollow tube element, having in particular a circular, oval, or polygonal cross-section. Optionally the plurality of structural elements may comprise a regular or arbitrary arrangement of hollow tube elements across the dichroic light exiting surface.

In some embodiments, at least one structural element may be configured as a pillar element, having in particular a circular, oval, or polygonal cross-section. Optionally the plurality of structural elements may comprise a regular or arbitrary arrangement of pillar elements across the dichroic light exiting surface, in particular across the regularly transmitted light.

In some embodiments, the plurality of structural elements may be configured as a wall structure to form the structural elements, wherein the wall structure may form, in particular regular, identical, and/or at least to some degree arbitrary diffused light passages having in particular a circular, oval, and/or polygonal cross-sections.

Further embodiments of the above aspects, are disclosed in the claims, which are incorporated herein by reference.

The different optical properties of the dichroic light can be achieved by providing Rayleigh-like (essentially visible light non-absorbing) scattering elements in a chromatic diffusing layer being active in the visible spectrum. Such scattering elements comprise nanoscale elements with a size in the range from, for example, about 10 nm to 500 nm such as nanoparticles or nanodroplets. With respect to nanoparticles in a chromatic diffusing layer, it is referred to an optical diffuser as disclosed in WO 2009/156348 A1, filed by the same applicants, that comprises an essentially transparent solid matrix in which a plurality of solid transparent nanoparticles are dispersed, e.g. in a thin film, coating, or bulk material such as sandwich embodiments. In the present description the terms "diffusing layer", or "chromatic diffusing layer" designate in general an optical element, which comprises a matrix embedding those (essentially transparent) nanoparticles. With respect to nanoscale elements and in particular nanodroplets it is referred to the international patent application entitled "TUNABILITY IN SUN-LIGHT IMITATING LIGHTING SYSTEMS", filed on the same day herewith by the same applicants, which is incorporated by reference herein.

Within the visible spectrum, the chromatic diffusing layer is in principle capable of (chromatically) separating different chromatic components of incident light having a broad spectral bandwidth in the visible range (such as in general white light) according to the same mechanism that gives rise to chromatic separation in nature. Rayleigh scattering is creating, for example, the spectral distribution characteristic of skylight and sunlight. More particularly, the chromatic diffusing layer is capable of reproducing—when subject to visible direct white light—the simultaneous presence of two different chromatic components: a diffused sky-like light, in which blue—in other words the blue or "cold" spectral portion—is dominant, and a directed light, with a reduced blue component—in other words the yellow or "warm" spectral portion.

In other words, the result of illuminating a chromatic diffusing layer with direct white light provides dichroic light exiting surface from which a directional light portion of direct light having a first correlated color temperature, and a diffused light portion of diffused light having a second correlated color temperature, which is larger than the first correlated color temperature, is emitted.

Usually, the illumination will be performed with a light beam such that the directional light portion of direct light is characterized by a directed angular luminous intensity distribution with at least one local luminous intensity peak for a specific location of the dichroic light exiting surface, wherein each local luminous intensity peak defines a local main direction of direct light propagation from that specific location. Due to the scattering process, the diffused light will comprise a local diffuse angular luminous intensity distribution that for a planar dichroic light exiting surface will be essentially Lambertian for each location on the dichroic light exiting surface and accordingly is essentially Lambertian for the entire dichroic light exiting surface at a large distance.

In some embodiments, a reflective configuration may be used for generating the dichroic light as disclosed in the above mentioned WO 2015/172821 A1, which uses a mirror with a mirroring surface and the chromatic diffusing layer in front of the mirroring surface. In those reflective configurations, also curved mirroring surface wherein the resulting local diffuse angular luminous intensity distribution herein is referred to as Lambertian-like.

In some embodiments, the lighting systems may be integrated in a wall or ceiling of a room and illuminate the room with a sun based illumination-like perception.

Other features and aspects of this disclosure will be apparent from the following description and the accompanying drawings.

BRIEF DESCRIPTION OF THE DRAWINGS

The accompanying drawings, which are incorporated herein and constitute a part of the specification, illustrate exemplary embodiments of the disclosure and, together with the description, serve to explain the principles of the disclosure.

In the drawings.

DETAILED DESCRIPTION

Figure 1:
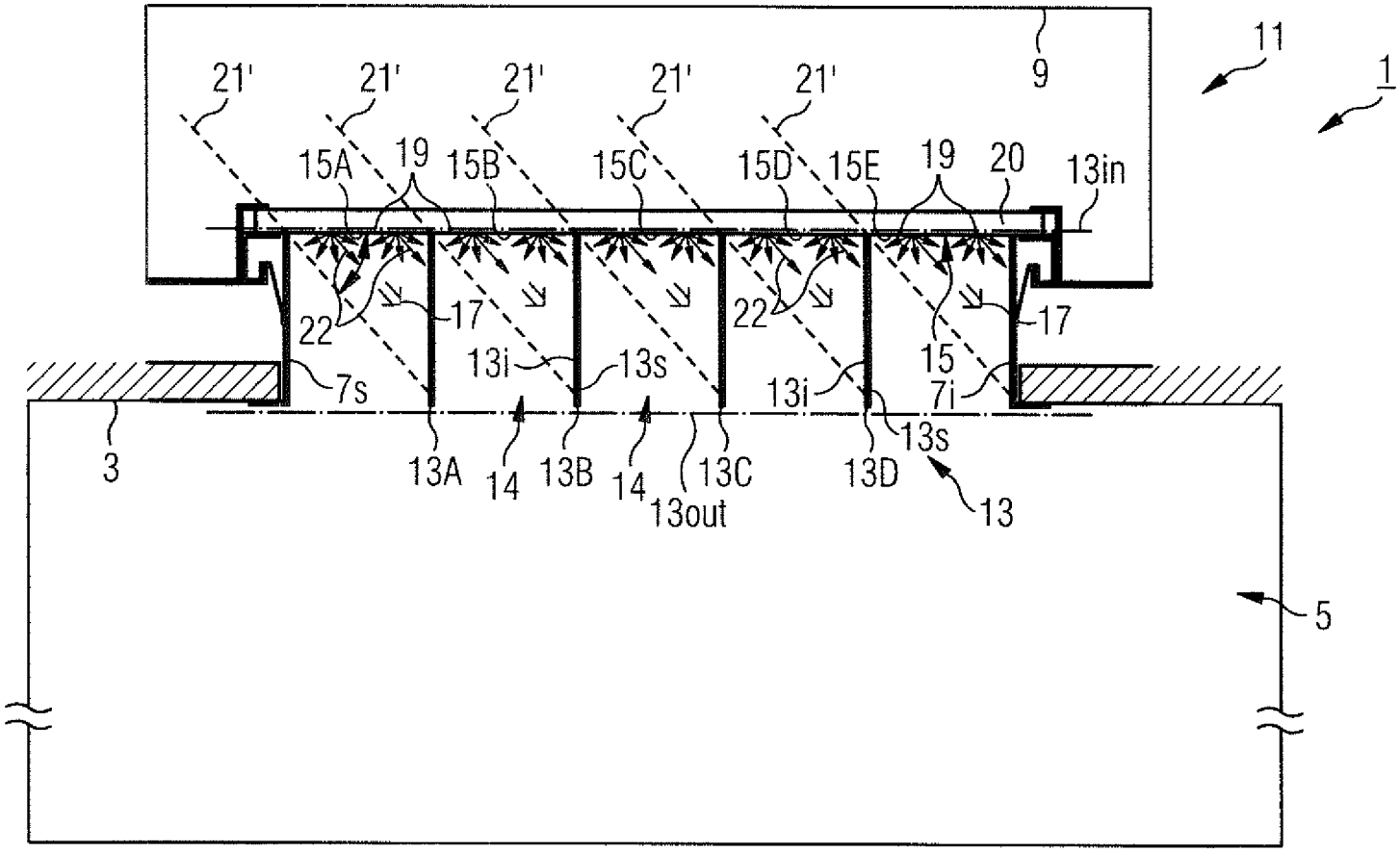
FIG. 1 is a schematic overview illustration of a lighting system with an appearance affecting optical system.

The following is a detailed description of exemplary embodiments of the present disclosure. The exemplary embodiments described therein and illustrated in the drawings are intended to teach the principles of the present disclosure, enabling those of ordinary skill in the art to implement and use the present disclosure in many different environments and for many different applications. Therefore, the exemplary embodiments are not intended to be, and should not be considered as, a limiting description of the scope of patent protection. Rather, the scope of patent protection shall be defined by the appended claims.

The disclosure is based in part on the realization that lighting systems, and in particular light sources for sunlight imitation, may be simplified, while maintaining the desired specific sun-sky perception if one introduces an appearance affecting optical system that specifically is configured to affect the appearance of the light source, such as a lamellae system that at least partially reflects the dichroic light but is configured and positioned within the direct light propagation. For example, it was realized that using an appearance affecting optical system allows smoothening structures that otherwise would be perceived when looking directly against the direct light from the light source.

Moreover, it was realized that using an appearance affecting optical system allows providing a more uniform luminance distribution for the area illuminated by the lighting system. This can be achieved by the optical properties of the surface or configuration of the e.g. lamellae structure.

In addition, secondary light sources may be integrated into the appearance affecting optical system such that the specific sun-sky perception is maintained but a desired uniformity is reached.

Herein, configurations of a plurality of structural elements are disclosed that affect the appearance of a lighting system by diffusing properties that broaden the angular luminous intensity distribution locally across the direct light "beam". This can be achieved, for example, by a diffuse reflection and/or a diffuse transmission of the direct light when interacting with the structural elements.

Moreover, herein configurations of structural elements are disclosed that result in a fragmented perception of the direct light/the direct light source. Thereby, only localized beamlets, which are distributed across the direct light "beam" may reach the eye of an observer unaffected. Localized beamlets can be achieved, for example, by a localized reflection and/or transmission of the direct light when interacting with the structural elements.

Furthermore, an angular broadening of the luminous intensity distribution across the direct light "beam" can be achieved globally by averaging local optical interactions that each do not broaden the luminous intensity distribution. Thereby, locally, e.g. at spatial portions of the structural elements, the width of the luminous intensity distribution is preserved after the optical interaction, but globally, e.g. considering the whole structural elements system, a widening effect is still obtained. This can be achieved, for example, by a specific localized reflection and/or transmission of the direct light when interacting with the structural elements.

It will be understood that also combinations of the various herein disclosed approaches to affect the appearance may be implemented in lighting systems. Moreover, while various optical measures will be explained herein for the reflective or the transmissive configuration, it will be understood that also the other type of the reflective or the transmissive configuration may implement the same in light of the optical relationship between the respective types of configurations.

For example, in some lighting systems pure specular reflection (undisturbed transmission), and in particular spread reflection (spread transmission) can be perceived as reflected (transmitted) sun light. However, in specific configurations disclosed herein, the perception is not detailed enough for an observer to link the perceived light with an underlying output aperture of a light source. Thereby, less complex optical configurations of light sources may be used while the sun-sky specific aspects of illumination can be maintained such as the depth effect created by the blue sky imitation and the perceived dependence of the illuminated regions with respect to an observer's position. In other words, it was realized that the impression of successful sunlight imitation can be achieved quite well for direct light sources that do not have fully flashed apertures as disclosed in the above mentioned WO 2015/172794 A1.

Herein, spread reflection is also referred to as diffuse reflective features or localized reflective features e.g. at a lamella's surface. Similarly, spread transmission is also referred to as diffuse transmitting features or localized transmitting features e.g. of a transmitting material of a lamella.

As disclosed herein, the appearance affecting optical system may be configured in various manners to achieve the task of, for example, breaking up a connection of the perceived image of the light source, e.g. breaking up the connection between the direct light features, and the existing luminance features of the light source.

Moreover, for some embodiments it was realized that one may maintain a localized perceived sun (in transmission or reflection) by providing an optical condition that maintains the vanishing tails of the direct light angular distribution. With essentially no tails, i.e. no direct light in the wings/large angles of the angular distribution, the effect is created that the direct light is only perceived in a limited angular range and the diffused (sky-imitating blue) light is perceived under those larger angles.

Referring to the schematic cut view of FIG. 1, a lighting system 1 is mounted at a ceiling 3 of a room 5. Lighting system 1 comprises a lighting unit 11 and an appearance affecting optical system 13. Appearance affecting optical system 13 is exemplary illustrated based on a plurality of planar lamellae 13A-13D that extend into the drawing plane. In general, lighting unit 11 comprises a light source (not explicitly shown in FIG. 1) and a dichroic light exiting surface 15.

Lighting unit 11 is configured for emitting dichroic light from dichroic light exiting surface 15. The dichroic light comprises a directional light portion of direct light 17 and a diffused light portion of diffused light 19. Herein, dichroic is understood to refer to the wavelength spectra associated with the two types of light portions. In general, each of the two types of light portions is characterized by a specific angular luminous intensity distribution that is associated with propagation directions of associated light rays.

Due to the specific configurations of appearance affecting optical system 13, dichroic light exiting surface 15 comprises various types of functional areas. Those functional areas can relate to whether there is or there is not an interaction of the emitted light with appearance affecting optical system 13. Moreover, those areas can be associated with the type light that originates or that can be perceived from a specific area. Those functional areas may at least partially overlap due to the presence of the two types of emitted light.

As explained above, for the specific feature of a sun-sky imitation, dichroic light exiting surface 15 emits a directional light portion of direct light having a first correlated color temperature, and a diffused light portion of diffused light having a second correlated color temperature, which is larger than the first correlated color temperature.

Looking at the optical interaction of appearance affecting optical system 13 with the directional light portion of direct light, one can associate direct light illuminated surfaces of structural elements of appearance affecting optical system 13 with associated affected direct light providing areas on dichroic light exiting surface 15. Direct light from an affected direct light providing area will optically interact with a structural element, be it, for example, a specific reflection at the surface or a specific transmission through the underlying material of the respective structural element. As appearance affecting optical system 13 is intended to affected the perception of the light source, the areal portion of dichroic light exiting surface 15, which is associated with affected direct light providing areas is at least, for example, 70%.

Referring to FIG. 1 and assuming a non-orthogonal incidence of the light from the light source, large lamellae 13A-13D, which extend far enough away from dichroic light exiting surface 15 and do not include e.g. openings, then all direct light of directional light portion of direct light will interact with lamellae, i.e. appearance affecting optical system 13. In FIG. 1, dichroic light exiting areas 15A-15E extend between lamellae 13A-13D. Under the above assumptions, those dichroic light exiting areas 15A-15E have the function of affected direct light providing areas as all direct light from each of the dichroic light exiting areas 15A-15E will interact with a lamella 13A-13D. That means that essentially almost 100% of the area of dichroic light exiting surface 15 is associated with affected direct light providing areas.

With respect to the perception of dichroic light exiting surface 15 by an observer, dichroic light exiting surface 15 may comprise diffused light areas from which some diffused light can pass through the appearance affecting optical system without interacting with the same.

Referring to FIG. 1, the diffused light areas also correspond to dichroic light exiting areas 15A-15E extending between lamellae 13A-13D because their complete area can be seen directly from below lighting system 1. In general, a diffused light area may overlap at least partly with one or more affected direct light providing areas.

Moreover, with respect to the perception of dichroic light exiting surface 15 by an observer, there may be also areas on dichroic light exiting surface 15 from which some direct light passes through appearance affecting optical system 13 without interacting with the same. Then, an observer below appearance affecting optical system 13 may see directly into some direct light emitted from the light source and leaving the lighting unit 11. The associated areas on dichroic light exiting surface 15 are herein referred to as unaffected direct light providing areas. As appearance affecting optical system 13 is intended to affected the perception of the light source, a direct unaffected look at the unaffected direct light should be only possible from some limited areas.

Referring to FIG. 1 and assuming lamellae 13A-13D do not include e.g. openings and extend far enough away from dichroic light exiting surface 15, the embodiment of FIG. 1 would not have any unaffected direct light providing area. In general, unaffected direct light providing areas may be small regions with limited extent (each small enough not to allow the observer to recognize the artificial aspect of the light source). Unaffected direct light providing areas may be distributed over dichroic light exiting surface 15 to not cover more than, for example, 30%. In general, an unaffected direct light providing area may also overlap with a diffused light area but of course is distinct from an affected direct light providing area.

To determine the above given exemplary values, in principle a test appearance affecting optical system can be used that is completely absorbing at the surface but in structure identical to the appearance affecting optical system. Then, any collimated impinging light (being equivalent to the far field illumination and providing essentially only local main directions without a divergence) passes such a test appearance affecting optical system only from the unaffected direct light providing areas. To clearly distinguish the effect onto direct light from effect onto diffuse light, additionally (in particular Rayleigh-like) scattering features of the lighting system can be removed such that only direct (regularly transmitted) light will impinge.

The directional light portion of direct light 17 has a first correlated color temperature and propagates essentially along a local main direction. As will be explained below in more detail, the local main direction corresponds to a peak in the angular luminous intensity distribution of direct light 17 emitted at a specific location from dichroic light exiting surface 15. Accordingly, a local main direct light ray originates from that specific location and propagates in the local main direction. Direct light 17 comprises in general direct light that is emitted in directions given by the angular luminous intensity distribution. A full width half maximum of that direct light with respect to a local main direction may be in the range from e.g. 3° (such as from e.g. 10°) up to 50° such as about 40°, 30°, or 20°.

The diffused light portion of diffused light 19 has a second correlated color temperature, which is larger than the first correlated color temperature of the direct light. The diffused light 19 radiates with a local diffuse (e.g. Lambertian-like) angular luminous intensity distribution emitted at a specific location from dichroic light exiting surface 15. Accordingly, diffuse light rays originate from a specific location in diffuse directions, e.g. evenly distributed in all directions, where the diffused light intensity emitted in a direction may relate to the surface shape. Assuming a Rayleigh scattering process causing diffusion of primarily blue light from incident light to create the diffused light portion and a planar Rayleigh-diffuser panel as explained below, a Lambertian angular luminous intensity distribution can be assumed for diffused light 19 exiting the downstream side of the plane Rayleigh panel (being in this case dichroic light exiting surface 15). As will be understood by the skilled person, any non-planar shape of the Rayleigh scatterer may result in a non-Lambertian-like angular luminous intensity distribution that, for example, could be considered to be a superposition of Lambertian emitters on that non-planar shape.

In some embodiments, lighting unit 11 may comprise a light tight housing structure 9 having, for example, a cover, side walls, and a bottom, thereby avoiding light, which does not originate from the light source or enters into light tight housing structure 9 backwards through dichroic light exiting surface 15, to create visual contributions to the perception of dichroic light exiting surface 15. Lighting unit 11 may further comprise a Rayleigh-diffuser panel 20. Rayleigh-diffuser panel 20 is, for example, a parallelepiped panel. In particular, Rayleigh-diffuser panel 20 is delimited by an inner surface and an outer surface, wherein the outer surface corresponds to dichroic light exiting surface 15.

Rayleigh-diffuser panel 20 may substantially not absorb light in the visible range and diffuse more efficiently the short-wavelength in respect to the long-wavelength components of the impinging light. E.g., Rayleigh-diffuser panel 20 diffuses light in the wavelength range 450 nm (blue) at least 1.2 times, for example at least 1.4 times, such as at least 1.6 times more efficiently than light in the wavelength range around 650 nm (red), wherein a diffusion efficiency is given by the ratio between the diffused light radiant power with respect to the impinging light radiant power. Optical properties and microscopic characteristic of Rayleigh-like diffusers are also described in detail in the patent application WO 2009/156348 A1 mentioned above. A further insight on exemplary microscopic features is also provided below.

Figure 2A:
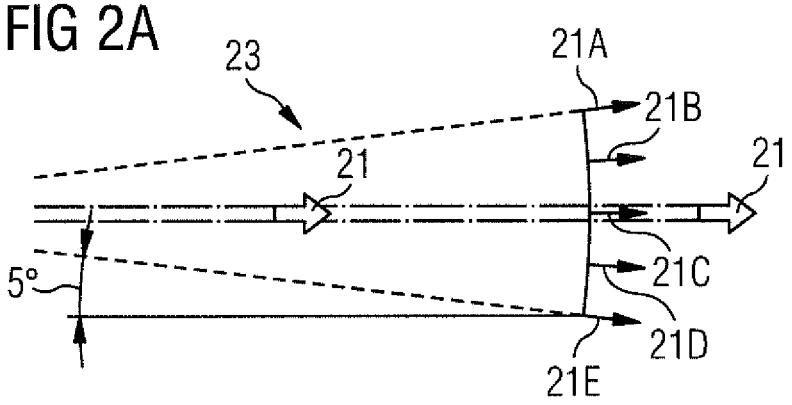
FIGS. 2A and 2B are schematic illustrations of direct light and a respective schematic illustration of a luminous intensity peak in the angular luminous intensity distribution of the direct light emitted at specific locations and respective Lambertian-like angular luminous intensity distribution of diffused light.
Figure 15A:
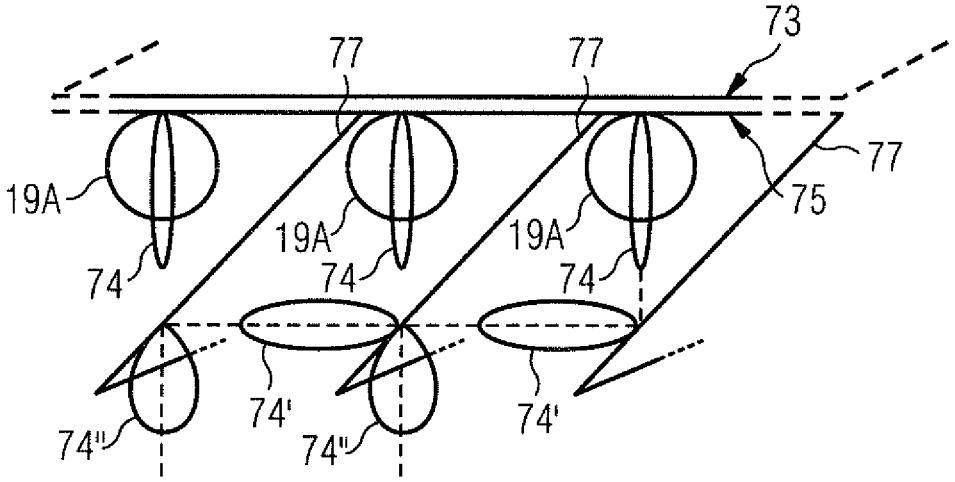
FIGS. 15A and 15B illustrate a further exemplary embodiment of a lamellae based lighting system.
Figure 15B:
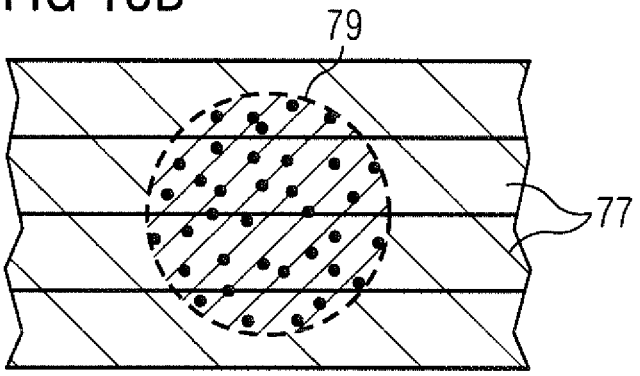

In some embodiments, the light source is configured to illuminates the inner surface of Rayleigh-diffuser panel 20 in its entirety under an angle of e.g. about 45° or about 60° (referring to a center light beam direction 21 of FIG. 2A with respect to a surface normal of Rayleigh-diffuser panel 20). For example, the light source may be vertically and horizontally displaced with respect to the center of Rayleigh-diffuser panel 20 and/or its light may be guided to illuminate Rayleigh-diffuser panel 20 under a desired angle. In some embodiments, the light source may comprise an array of sub-light sources distributed across chromatic light exiting surface to provide a compact system, e.g. with orthogonal direct light emission as shown in FIGS. 15A and 15B.

Figure 2B:
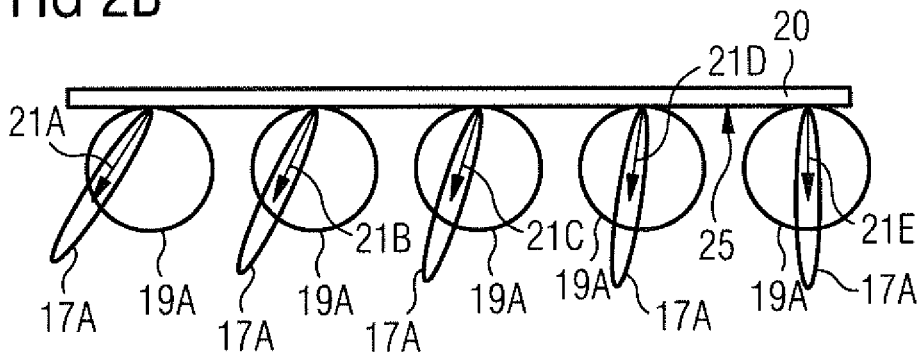

Referring additionally to FIGS. 2A and 2B, a light source may be configured to emit light in an emission solid angle of e.g. 10° FWHM, thereby forming a direct light beam 23. In the far field, light of direct light beam 23 will propagate essentially along local main directions 21A-21E (indicated as arrows in FIGS. 2A and 2B). Due to the emission solid angle, local main directions 21A-21E are increasingly inclined with respect to center light beam direction 21 of light beam the further a light ray is apart from the center of direct light beam 23. Assuming direct light beam 23 interacts with planar Rayleigh-diffuser panel 20 in such a far field, at each location of planar Rayleigh-diffuser panel 20, the local luminous intensity peak of the directed angular luminous intensity distribution for a specific location is aligned along the respective local main direction 21A-21E across Rayleigh-diffuser panel 20.

As will be understood by the skilled person, upstream of the far field (i.e. in an intermediate field between the near field and the far field), at each location across direct light beam 23, light will still comprise a plurality of propagation directions, e.g. within a local emission solid angle of e.g. (below) 10° FWHM. Accordingly, illuminating a planar Rayleigh-diffuser panel would result in an essentially constant local main direction across the planar Rayleigh-diffuser panel (as illustrate in FIG. 1 by arrows 22), where the local light rays cover essentially the emission solid angle.

With respect to generating the diffused light by Rayleigh/Rayleigh-like scattering, in both cases of a far field and an intermediate field illumination, the diffused light from planar Rayleigh-diffuser panel 20 has essentially the same Lambertian angular luminous intensity distribution at each location across the planar Rayleigh-diffuser panel 20 (as illustrate in FIG. 1 by distributed arrows).

For far field illumination of Rayleigh-diffuser panel 20, FIG. 2B illustrates schematically the change in direction of local main directions 21A-21E of a respective directed angular luminous intensity distribution 17A of direct light 17 together with locally invariant Lambertian diffuse angular luminous intensity distribution 19A of diffused light 19.

Referring again to FIG. 2A, a light source may emit light in the visible region of the light spectrum, for example, with wavelengths between 400 nm and 700 nm. For example, the light source emits light (visible electromagnetic radiation) with a spectral width preferably larger than 100 nm, more preferably larger than 170 nm. The spectral width can be defined as the standard deviation of the first light source's wavelength spectrum. A respective light source is disclosed in the above mentioned WO 2015/172794 A1, where the light source is specifically configured to emit light in a narrow emission solid angle to form a light beam propagating along a main light beam direction.

While the light source disclosed in WO 2015/172794 A1 is configured specifically for fully flashed illumination, i.e. an almost perfect sun imitation, more simple configurations (with respect to less restricted emission solid angles and homogeneity of appearance) may be used in the herein disclosed concepts due to the herein disclosed specific measures that are taken. Specifically, in some embodiments, the herein disclosed concepts avoid that an observer will be able to look undisturbed into the light source, i.e. into the direct light emitted from dichroic light exiting surface 15. As mentioned, in some embodiments, there may be some undisturbed direct viewing angles onto direct light areas of dichroic light exiting surface 15 against a respective local main direction, e.g. through holes in a lamella. However, the overall perception is significantly influenced by appearance affecting optical system 13.

Specifically, the herein disclosed concepts include the provision of a plurality of (at least partly) reflective and/or (at least partly) transmitting structural elements (herein generally referred to as optical structural element configurations). Moreover, the herein disclosed concepts include the provision of breaking up the perceived direct light into beamlets by specific shapes and/or sizes of the structural elements (herein generally referred to as geometric structural element configurations).

In general, the structural elements extend in-between an entrance side 13in and an exit side 13B of appearance affecting optical system 13 (schematically indicated in FIG. 1). Entrance side 13out is located at the side of chromatic light exiting surface 15. The structural elements comprise direct light illuminated surface regions that are subject to the illumination with direct light from an associated direct light affected area, and the plurality of structural elements forms a plurality of diffused light passages 14 that extend from the entrance side to the exit side.

The structural elements may be formed to extend into the directional light portion. The structural elements may comprise e.g. thin, essentially two-dimensional, segments or individual pillar-like elements that have a front face subject to the direct light illumination and a back face in the shadow. The diffused light passages may at least partially be delimited by a respective direct light illuminated surface region. The diffused light passages may be configured to allow the view onto a portion of the dichroic light exiting surface 15

(the above mentioned diffused light areas) from a light passage specific range of observation angles. Thus, at least some diffused light may propagate without interaction of the "walls" delimiting the diffused light passage. In other words, the diffused light passages may be configured to allow perceiving some of the diffused light from the light exiting surface without interaction of the diffused light with any structural element.

In contrast, the structural elements are specifically configured to reduce significantly the amount of the directional light portion that is seen without any interaction with a structural element. For example, the direct light passing appearance affecting optical system 13 without interaction with any structural element comprises less than 30% of the energy of the directional light portion. For example, the structural elements, and in particular the direct light illuminated surface regions, extend in combination over the cross section associated with the local luminous intensity distribution of direct light to an extent such that the light associated with about or more than 70% of the energy of the directional light portion interacts with the structural elements. For example, when the structural elements, and in particular the direct light illuminated surface regions, extend within a local depth range into the direct light beam and with respect to the dichroic light exiting surface such that each structural element interferes with at the most ⅓ of the complete cross section of the directional light portion, at least three structural elements are needed.

In some embodiments, the structural elements each extend within local depth ranges and lateral width ranges with respect to the light exiting surface such that at least 70% of the radiant flux, i.e. the power, of the directional light portion is incident on direct light illuminated surface regions. The remaining part of the directional light portion not being incident on direct light illuminated surface regions is spatially distributed over the light exiting surface, thereby still allowing a sufficient effect onto the perception by appearance affecting optical system 13.

In the following, at first, examples of optical structural element configurations will be explained, e.g. for planar lamellae configurations. Thereafter, exemplary geometric structural element configurations are described such as grid lamellae structures and pillar structures.

Referring again to the schematic cross-sectional view of FIG. 1, lighting system 1 is optically coupled to a region to be illuminated in room 5 via appearance affecting optical system 13. In the exemplary embodiment, appearance affecting optical system 13 comprises the plurality of planar lamellae 13A-13D with side faces 13*i*, 13*s*. From an associated dichroic light exiting area 15A-15D of the light exiting surface 15, each of lamellae 13A-13D is subject to the illumination with direct light 17 on one side only, specifically on side faces 13*i*, while side faces 13*s* are in the shadow.

In the exemplary configuration of FIG. 1, lighting system 1 is integrated into a recessed area within ceiling 3 such that side walls 7*i*, 7*s* form a lightwell-type structure within ceiling 3. While in FIG. 1, side wall 7*i* is similarly illuminated by direct light 17 as the illuminated side faces 13*i* of lamellae 13A-13D, side wall 7*s* is in the shadow similar to side faces 13*s*.

It will be understood that with respect to the areal portion of the affected direct light providing areas, one can similarly associate an affected direct light providing area with any illuminated side wall 7*i* of such a lightwell structure that is configured in its optical properties similarly to the structural elements. In that sense, side wall 7*i* can be considered functionally to be part of appearance affecting optical system 13 because it contributes to the effect on the appearance of the light source. As will be understood by the skilled person, being a side wall, its optical properties generally would be limited to the reflective configuration if it should be equal to a structural (reflective) element and be associated to a respective affected direct light providing area. But even in transmission configurations, for the purpose of the herein disclosed ranges of the area ratios, an illuminated side wall 7*i* can be associated to an affected direct light providing area.

In FIG. 1, side face 13*s* is in the shadow as only a single light source is assumed to illuminate the lamellae from one side. Accordingly, there is no affected direct light providing area associated with side face 13*s*. It is noted that in some configurations, more than one direct light direction may be present (see e.g. the disclosure in connection with FIGS. 14A, 14B) such that both side faces 13*i*, 13*s* as well as both of side walls 7*i*, 7*s* may be illuminated.

In FIG. 1, neighboring structural elements (lamellae 13A-13D) are associated with neighboring dichroic light exiting areas 15A-15D, respectively. In general, when the structural elements are essentially in contact with dichroic light exiting surface 15, the dichroic light exiting area (e.g. dichroic light exiting area 15C), which is associated with a direct light illuminated surface of one of the structural elements (e.g. lamella 13C), is the region between two consecutive lamellae (e.g. lamella 13B and 13C).

In FIG. 1, dashed lines 21' illustrate the propagation of those local main direct light rays (along the respective local main directions) that impinge on lamellae 13A-13D (and side wall 7*i*) the furthest away from dichroic light exiting surface 15. Accordingly, affected direct light providing areas, in this case dichroic light exiting areas 15A-15E, extend from the crossing of dashed lines 21' with dichroic light exiting surface 15 to the point where the respective lamella touches dichroic light exiting surface 15.

Figure 3:
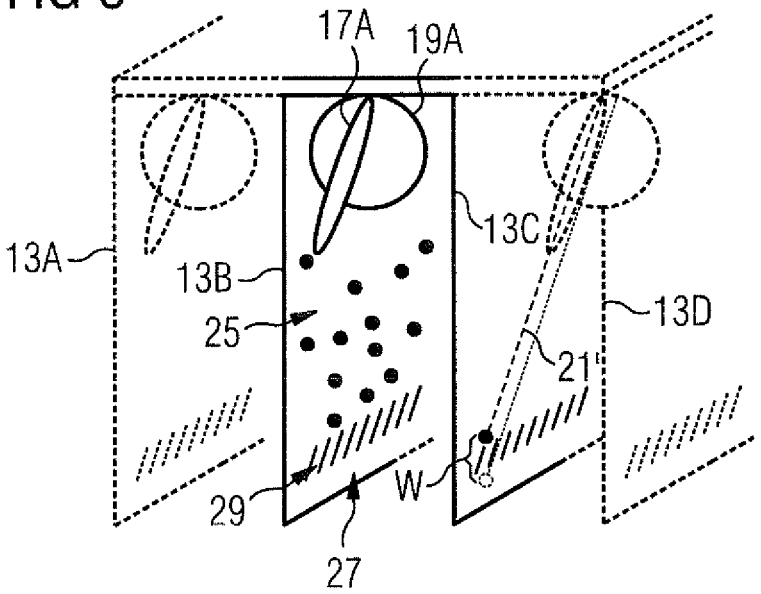
FIG. 3 is an illustration of the illumination of a lamellae system being illuminated with direct light and diffused light.
Figure 12A:
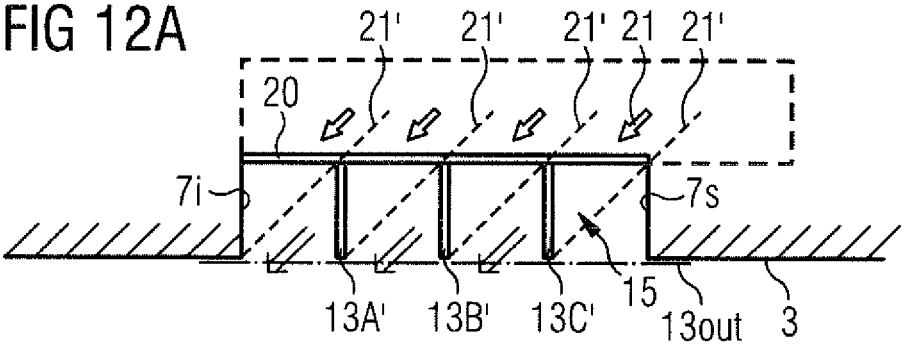
FIGS. 12A to 12D illustrate schematic cross-sections of further exemplary embodiments of lamellae based lighting systems.
Figure 12B:
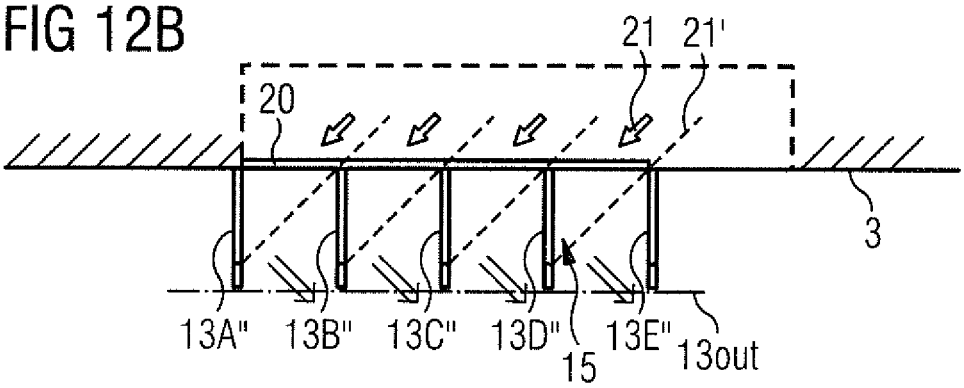
Figure 12C:
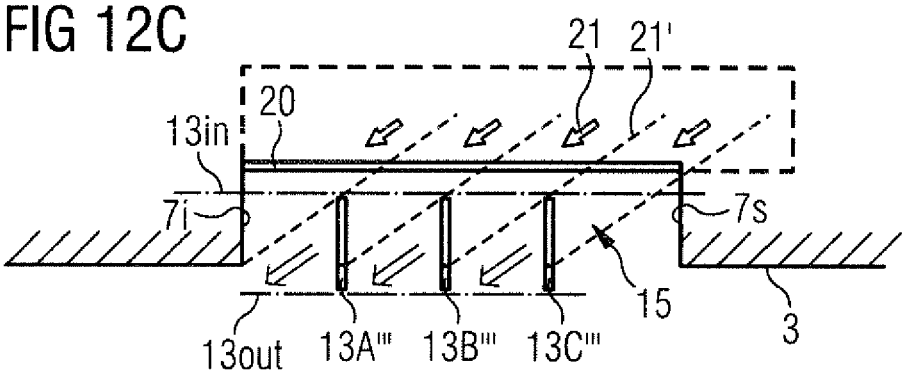
Figure 12D:
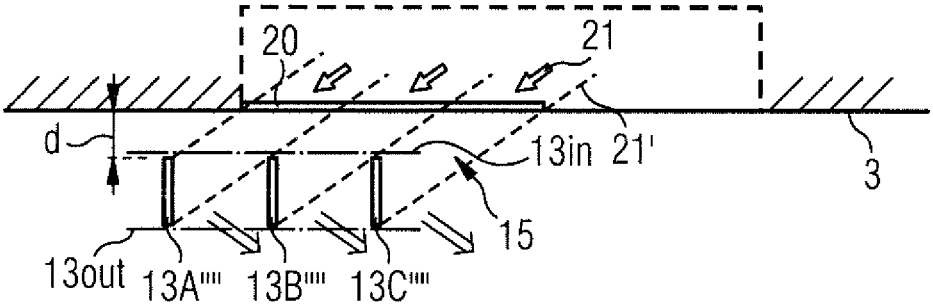

It is noted that in some configurations, a lamella may not touch dichroic light exiting surface 15 such that the affected direct light providing areas are delimited additionally by another local main direct light ray impinge on lamellae 13A-13D (and side wall 7*i*) the nearest to dichroic light exiting surface 15 (see e.g. the disclosure in connection with FIGS. 12C, 12D). In general, the extent of affected direct light providing areas may vary across dichroic light exiting surface 15 due to variations in appearance affecting optical system 13 (see e.g. the disclosure in connection with FIGS. 17A to 17C). Referring to FIG. 3 and the following discussion, also an area next to a direct light illuminated surface region (defined by the local main direct light rays along the respective local main directions) may be dominated by direct light features.

FIG. 3 illustrates an exemplary illumination of four lamellae 13A-13D with the dichroic light. The dichroic light is schematically illustrated by angular luminous intensity distributions 17A and 19A. Assuming those angular luminous intensity distributions to be present at each location of dichroic light exiting surface 15, lamellae 13A-13C includes a first region illuminated with direct light 17 and diffused light 19, herein referred to as direct light illuminated surface region 25. The dots in FIG. 3 illustrate selected impinging points of direct light rays propagating along a local main direction. Next thereto and further away from dichroic light exiting surface 15, there is a diffused light illuminated surface region 27 onto which only diffuse light will impinge (i.e. no dots are shown). This is due because the contribution of the diffused light is greater for large angles than the contribution of the direct light as the tails of direct light decay angularly very fast and can be considered negligible. Also in a sub-region 29 of direct light illuminated surface regions 25, indicated by dashed lines in FIG. 3, there is no direct light impinging that propagates under a local main direction (also in sub-region 29, there are no dots shown). In other words, only light from one side of directed angular luminous intensity distribution 17A (with respect to the local main directions) can reach that sub-region 29. Accordingly, in the plane of reflection, the width of sub-region 29 is limited by half the direct angular luminous intensity distribution 17A as schematically indicated in FIG. 3.

Figure 5:
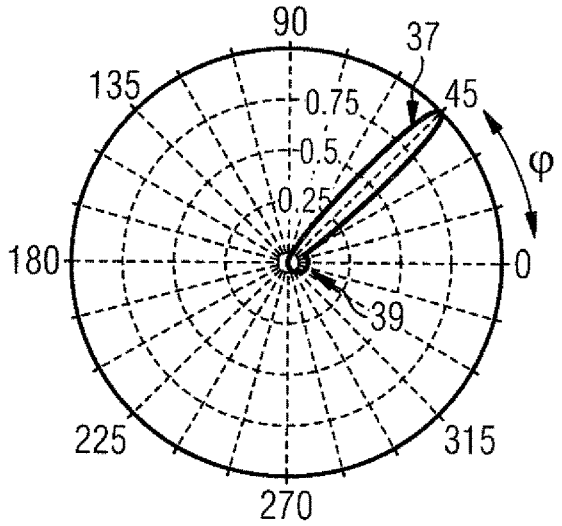
Figure 6A:
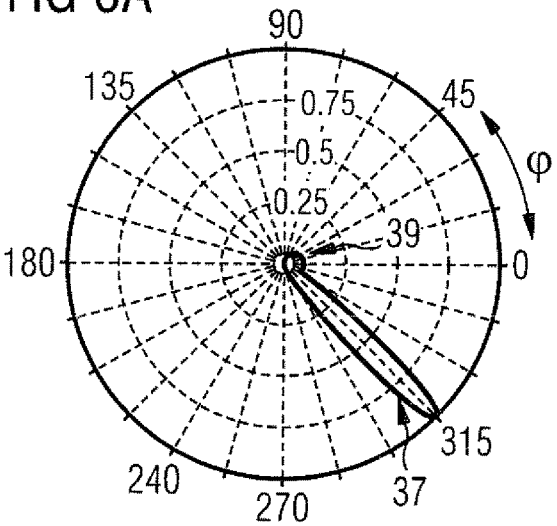
Figure 6B:
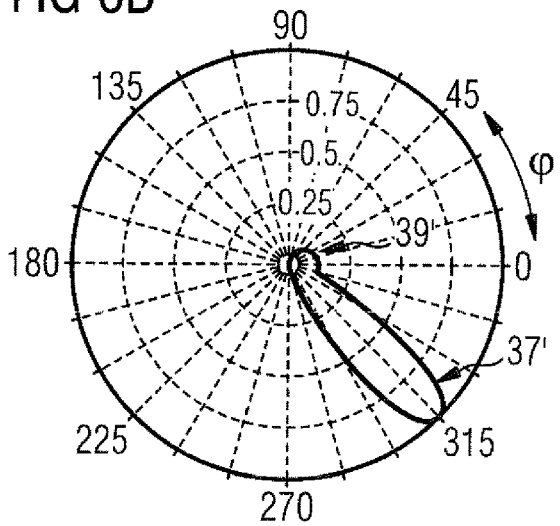
Figure 7:
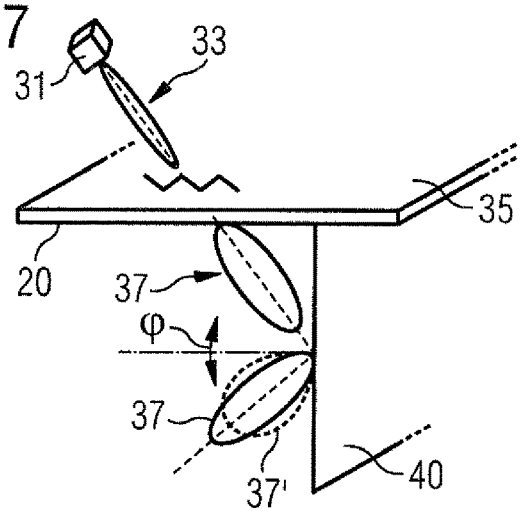

In connection with FIGS. 4 to 9B, the effect of a reflective lamella onto the appearance of lighting system 1 is illustrated based on polar and Cartesian plots of the luminous intensity distribution, i.e. the light power emitted by lighting system 1 in a particular direction per unit solid angle (weighted by the luminous efficiency functions) along the plane of reflection on affecting optical system/lamella 40 as exemplarily depicted in FIG. 7. The luminous intensity distribution depends on two angular coordinates 4, cp. In the illustrated polar plots, the angular coordinate cp is directed in the plane of reflection such as in the polar plots of e.g. FIGS. 4 to 6B. In those polar plots, the luminous intensity is illustrated in a linear arbitrary scale, with the maximum luminous intensity each time being set to 1. FIG. 7 schematically illustrates an exemplary optical configuration for reflecting structural elements. As will be understood, the case of transmitting structural elements, the (reflected) luminous intensity distribution at 315° would maintain at 45°.

Figure 4:
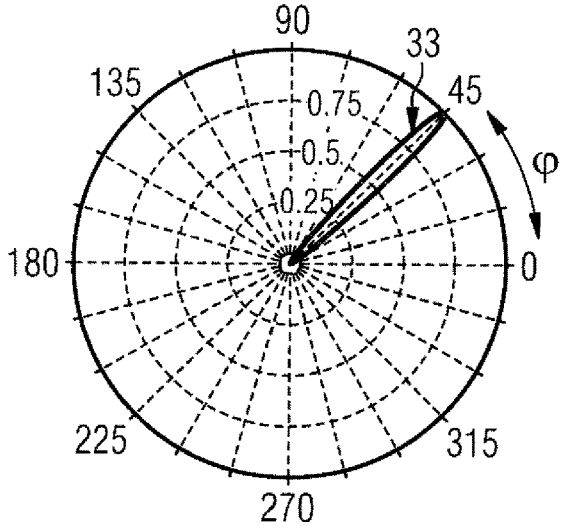
FIGS. 4 to 7 illustrate the formation of an angular luminous intensity distribution of an exemplary embodiment of a lamellae based lighting system.

Specifically, FIG. 4 shows a polar plot of the luminous intensity distribution of a light beam 33 emitted from a light source 31 (see FIG. 7) for the angular coordinate cp (i.e. without the diffuser panel and the appearance affecting optical system/lamella 40). Light beam 33 is the basis for the generation of the directional light portion and the diffused light portion. The maximum of the luminous intensity of light beam 33 is at 45°, i.e. light beam 33 impinges under an angle of 45° onto a Rayleigh-diffuser panel 35. For light beam 33, an angular width of the luminous intensity distribution in the angular coordinate φ is about, for example, 10°.

FIG. 5 shows a polar plot of the luminous intensity distribution after light beam 33 interacted with e.g. a Rayleigh-diffuser panel 35 (see FIG. 7, i.e. without the appearance affecting optical system/lamella 40). One recognizes a directional light portion 37 and a diffused light portion 39. Directional light portion 37 still propagates in a direction of 45°, however, with a broadened angular width of e.g. about 15°. This broadening was exemplarily added using e.g. forward scattering at larger scattering centers within Rayleigh-diffuser panel 35. In addition, the Rayleigh scattering resulted in the generation of diffused light portion 39 having a Lambertian luminous intensity distribution that is indicated by a small circular-looking curve section at low intensity.

FIGS. 6A and 6B show polar plots of the luminous intensity distribution for an optical path of directional light portion 37 and a diffused light portion 39 that includes a purely specular or diffuse specular reflection from a lamellae configuration, respectively (see FIG. 7, i.e. with only a single reflective interaction with the appearance affecting optical system/lamella 40).

For directional light portion 37, the effects of a specular or diffuse specular reflective lamellae system is further illustrated in FIG. 7. Any incident light will be redirected due to the reflection e.g. at a reflective layer, such as metallic surface, of a lamella 40 of the lamellae system. For a pure specular reflection, the resulting luminous intensity distribution of FIG. 6A is similar to the one of FIG. 5 wherein, however, directional light beam portion 37 now propagates in a direction of 315°. For simplicity, the same reference numeral is used for directional light beam portion 37 before and after specular reflection, indicating that the luminous intensity distribution associated with the direct light did not change.

In contrast, FIG. 6B shows a polar plot of the luminous intensity distribution for a diffuse specular reflection, e.g. by a lamella having a surface roughness. As a consequence of the diffusing action, the luminous intensity distributions of the directed light broadened in its angular width to e.g. about 20° or more such as about 28° resulting in a diffuse reflected directional light portion 37'. Due to the broadening, the maximum luminous intensity of diffuse reflected directional light portion 37' decreased and the relative strength of a diffuse reflected diffused light portion 39 increased (indicated by a slight enlargement of the circular-looking curve at low intensities when compared to FIG. 6A). In FIG. 7, diffuse reflected directional light portion 37' (i.e. after a diffuse reflection) is furthermore indicated in dashed lines.

In this context, the aspect of divergence/angular distribution of light rays/the associated aperture angle, a local reference system can be considered having the z-axis directed along the local main direction. Then, the direction of the local luminous intensity peak (for a specific location of the dichroic light exiting surface 15) corresponds to that z-axis. Moreover, the full width half maximum of the angular luminous intensity distribution can be defined in that local reference system as the full width half maximum of the average distribution obtained by averaging on the directions orthogonal to such z-axis. Further, two possible sections of the angular luminous intensity distribution can be considered: a first section of the luminous intensity distribution along a first plane containing that z-axis and the normal to the light exiting surface (plane of reflection for the reflective configuration, for example), and a second section along a plane orthogonal to that first plane and passing through the z-axis.

For example, the directed angular luminous intensity distribution associated with a specific location of the dichroic light exiting surface (15) has a full width half maximum that is about or smaller than 40°, 30°, or even 20°, and in particular with respect to a specific plane is about or smaller than 40°, 30°, or even 20°.

The output directed angular luminous intensity distribution associated with a specific location on the (reflective) side face may have full width half maximum that increased with respect to a directed angular luminous intensity distribution prior transmission (reflection) by at least 2% such as 5%, or 10% or even 100% but increases not beyond 50°, such as 40° or less, e.g. about 30° or 20°.

Similar increases of the output directed angular luminous intensity distribution may take place within a specific plane. For example, the output directed angular luminous intensity distribution associated with a reflected local main direction in the plane of reflection may have a full width half maximum that is about or smaller than 50°, such as 40° or less, e.g. about 30° or 20°. It may differ for two orthogonal planes.

Figure 8A:
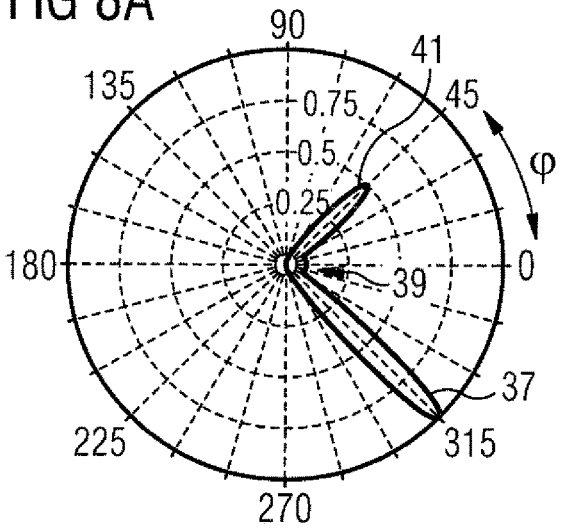
FIGS. 8A and 8B illustrate angular luminous intensity distributions of an exemplary embodiment of a lamellae based lighting system providing a two lamellae reflection pathway for direct light.
Figure 8B:
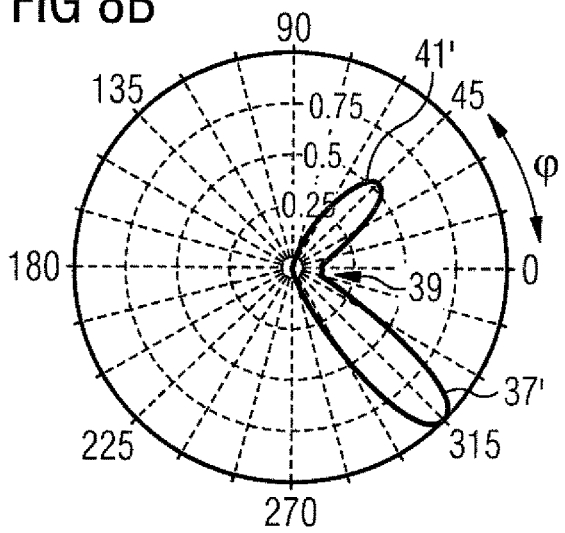

Assuming that the lamellae reach further out from Rayleigh-diffuser panel 35, some of the reflected direct light will be incident onto a backside of a neighboring lamella (not shown in FIG. 7). FIGS. 8A and 8B illustrate the luminous intensity distributions for the case that also the backsides of the lamellae are specular and diffuse specular reflective, respectively. Generally, two or more specular reflections or diffuse specular reflections are possible for the direct light when passing through a long enough lamellae structure of the appearance affecting optical system.

As can be seen in the exemplary polar plots of FIGS. 8A and 8B, not all of the (specular or diffuse specular) reflected direct light performs a second reflection. Accordingly, the luminous intensity distributions maintain (diffuse) reflected directional light portions 37 or 37' as a primary larger peak and show additionally secondary peaks associated with twice (diffuse) reflected directional light portion 41 and 41', respectively.

Referring to FIG. 8B, it is noted that the secondary peak of twice diffuse reflected directional light portion 41' is further broadened due to the second diffuse reflection, resulting in e.g. an angular width of about 25° or more such as about 35°.

As will be understood, depending on the geometry such as parallel or inclined lamellae, their separation and length, and the light incidence angle, various modifications of the directions and ratios of the resulting directional light portions can be created.

Figure 9A:
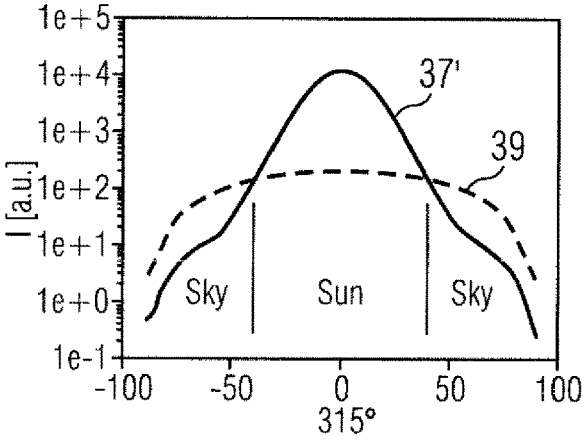
FIGS. 9A and 9B illustrate angular luminous intensity distributions of an exemplary embodiment of a lamellae based lighting system providing a two lamellae reflection pathway for direct light in a plane orthogonal to the plane of reflection and a plane extending through a direct light peak associated with the first reflection and second reflection, respectively.
Figure 9B:
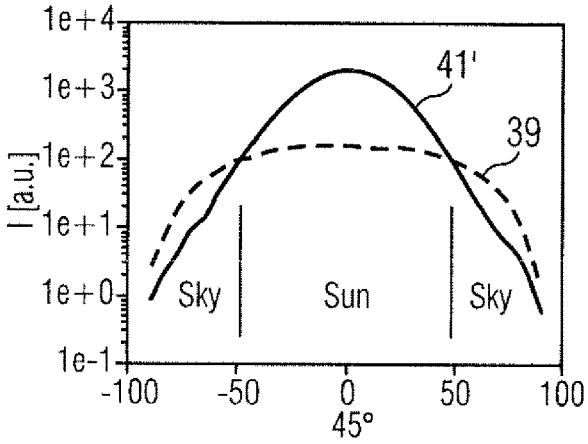

FIGS. 9A and 9B illustrate luminous intensity distributions for the situation of FIG. 8B for the angular coordinate $\vartheta$, with $\varphi$ set at +315° and 45°, respectively. Therein, the luminous intensity is illustrated when crossing reflected directional light portions 37' and 41' at their maximum intensity in a direction orthogonal to the plane of reflection. In contrast to the foregoing polar plots, the Cartesian plots of FIGS. 9A and 9B show separate lines for direct light (though lines) and diffused light (dashed lines). Moreover, the luminous intensities are shown in a logarithmic scale.

One recognizes the peaks in the intensity distributions within the plane of reflection, i.e. at 0°, and a larger angular width with lower intensity for twice diffuse reflected directional light portion 41'. In each plot, three zones are illustrated: a center zone "sun" and two surrounding zones "sky". When looking from one of the zones onto a lamella, one will primarily perceive the color of the related zone, e.g. a bright white/yellow sun within zone "sun" and a blue within the zone sky. In other words, the color of the perceived light will be dominated by the CCT of the direct light as long as the luminous intensity of the perceived directional light portion is larger or at least identical to the luminous intensity of the perceived diffused light portion. This is the case in zone "sun".

Due to the (diffuse) reflective property of the lamellae (in combination with the angular distribution of the direct light before impinging on the lamella), there is a strongly decreasing tail in the direct light's luminous intensity for large angles. As can be seen due to the logarithmic scale, at angles beyond about 50°, the diffuse light becomes dominant such that e.g. a bluish color (the CCT of the diffused light) will be perceived when looking under those larger angles onto the lamellae configuration. This is the case in zone "sky".

Assuming a sufficiently long lamella, an observer will thus perceive a change in the color of the lamella from white—when he looks in the reflected direct light—to blue. It is noted that the same applies to the angular coordinate $\varphi$ but due to the reduced size of lamellae 40 in that direction, an observer will primarily look under essentially one angle onto each lamella. Thus, only close to the transition angle of about 50°, an observer may see regions of differing colors on a single lamella. Of course, looking at different lamella, similarly the perception is governed by the respective zone of observation.

Figure 10:
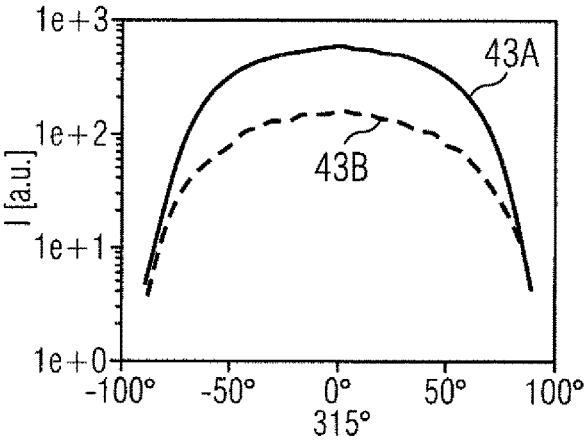
FIG. 10 illustrates an angular luminous intensity distribution for diffuse reflecting lamellae.

For comparison, FIG. 10 illustrates luminous intensity distributions for direct light 43A and diffused light 43B similar to FIG. 9A, however, in the case of a lamella surface that acts as a diffuser, e.g. a white (non-mirroring) lamella. As can be seen, in that situation, the light scattered e.g. in a Lambertian-like way by the lamella will not be perceived from any angle with a luminous intensity of the diffused (bluish) light that is larger than the one derived from the direct (white, yellowish) light, e.g. the direct light scattered by the lamella. Accordingly, despite the dichroic illumination, a change in color is essentially not perceived by an observer looking at the lamella, which will appear essentially always to be within the zone "sun".

Figure 11A:
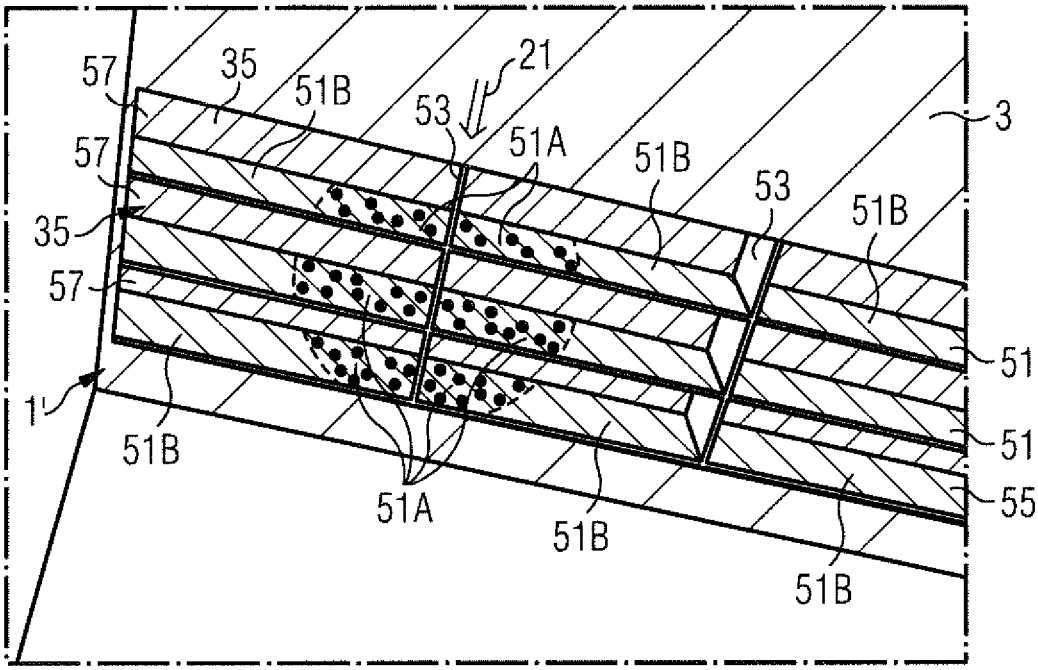
FIGS. 11A and 11B illustrate the perception of exemplary embodiments of lamellae based lighting system.
Figure 11B:
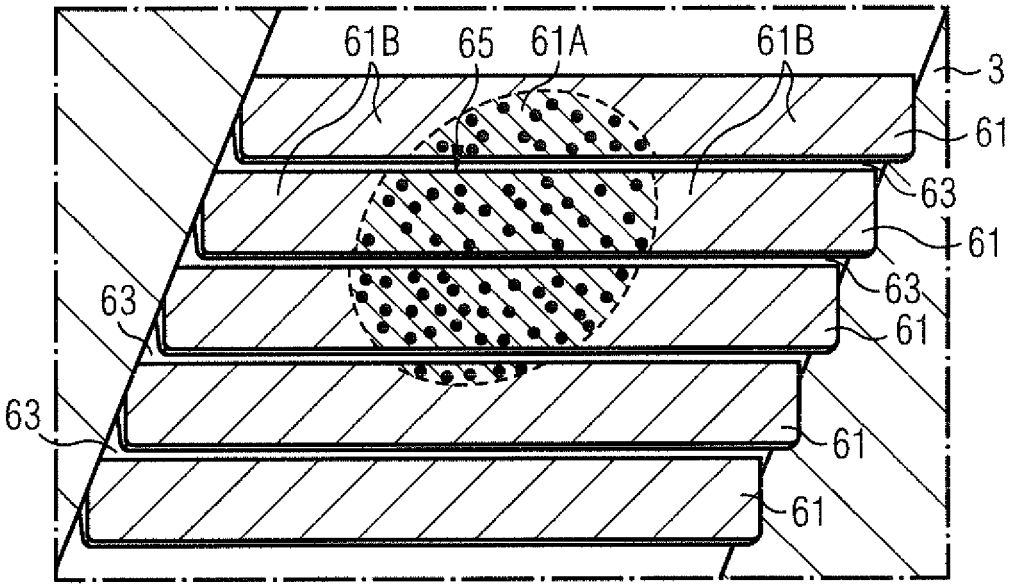

FIGS. 11A and 11B illustrate schematically the change in perceived colors across a lamellae configuration illuminated by a Rayleigh diffuser for diffuse reflective lamellae and diffuse transmitting lamellae, respectively.

FIG. 11A shows a perspective view onto a lighting system 1' that is located at a corner of ceiling 3 of a room. Lighting system 1' comprises a grid of two long lamellae 51 and at least two short lamellae 53. It is assumed that the lamellae touch a planar Rayleigh diffuser that is displaced from ceiling 3 by the height of the lamellae 51, 53 and that inner long sidewalls 55 and inner short sidewalls (not viewable in FIG. 11A) extend along the border of the Rayleigh diffuser to connect to the ceiling's plane (forming the sidewalls of a lightwell in ceiling 3). The planar Rayleigh diffuser is illuminated by a white light source along the small lamellae 53 but with an inclination angle of e.g. 45° degrees with respect to the plane of the Rayleigh diffuser as schematically indicated by center light beam direction 21.

The optical surface of at least the illuminated side of long lamellae 51 is diffuse reflective. Similarly, at least the illuminated long sidewall 55 is configured in its optical features as long lamellae 51. Short lamellae 53 as well as short sidewalls (not viewable in FIG. 11A) may be configured in their optical surface features in a manner similar to long lamellae 51 or differently, e.g. as diffusive scatterers.

When looking under 45° within the plane of reflection onto lighting system 1' (i.e. from within the angular range of diffuse reflected directional light portion 37), an observer sees diffused light areas 57 on Rayleigh-diffuser panel 35 from which part of the diffused blue light passes the lamellae configuration without interaction. Moreover, the observer will see direct light illuminated surface regions of long lamellae 51. However, due to the directionality of the white light, the observer will see only a limited area 51A being bright lit up (i.e. as reflecting white sun-like light), while at larger angles long lamellae 51 primarily reflect blue light onto the observer such that side areas 5113 at the sides of limited area 51A appear blue. As a result, the observer will assume a bright sunny day with a blue sky and some sunrays diffuse reflected into the room.

A section of a lamellae configuration based on diffuse transmitting lamellae is illustrated in FIG. 11B. Similar to FIG. 11A, a Rayleigh diffuser of a lighting system 1" is integrated into ceiling 3. However, parallel lamellae 61 extend in this configuration below the plane of ceiling 3.

The optical features of lamellae 61 results in a transmission of any impinging light with some limited additional diffusion of the light propagation directions. For the diffused blue light, the additional diffusion is essentially not noticed such that the appearance of the lamellae 61 and of e.g. the Rayleigh diffuser will be quite similar, at least in color because no direct light is perceived from an area 61B. With respect to the transmitted direct white light, the perceived size of the direct light beam will be increased such that the limited area 61A being bright lit up is perceived enlarged with respect to the perceived area of the sun image in the absence of e.g. lamellae 61. In FIG. 11B, the position of the observer is such that only the backsides of lamellae 61 are seen separated by essentially only small stripes 63 of the blue Rayleigh diffuser. As the depth of lamellae 61 and the inclination angle of center light beam direction 21 are selected such that essentially no direct light (or less than 30% of the radiant flux of the direct light) can pass by the lamellae configuration without interaction with the lamellae configuration, the observer sees mainly blue lamellae around a sun-like appearance of a bright circular area 65.

It is noted that in line with the optical concepts disclosed in the above mentioned disclosures, the perceived position of limited bright lit-up region on the exit side of the appearance affecting optical system depends on the viewing angle and will therefore move across the exit side while e.g. crossing the range of the directional light portion of the lighting system.

FIGS. 12A to 12D illustrate exemplary cross-sectional views of lamellae arrangements in reflective or transmitting configurations.

The lamellae arrangement of FIG. 12A is similar to those embodiments discussed in connection with FIGS. 1, 3, and 11B. However, dashed lines 21' touch the lower end of each lamellae 13A', 13B', 13C'. Therefore, there are no diffused light illuminated surface regions on lamellae 13A', 13B', 13C' and a small amount of direct light of the directional light beam portion may pass through the lamellae arrangement without interacting with any lamella 13A', 13B', 13C'. As the lamellae 13A', 13B', 13C' are (diffuse) transmitting, that leaking direct light may be seen as bright stripes between the lamellae under respective observation angles. However, the amount of that leaking direct light is limited and distributed over the perceived area such that e.g. a substructure of the light source aperture is not noticed.

The lamellae arrangement of FIG. 12B is similar to the embodiment discussed in connection with FIG. 11B, however, lamellae 13A" to 13E" are reflective and dichroic light exiting surface 15 extends within the plane of ceiling 3. Lamellae 13A" to 13E" are in vertical direction large enough such that all direct light is reflected at least once.

The lamellae arrangement of FIG. 12C is similar to the embodiment discussed in connection with FIG. 12A. However, lamellae 13A'" to 13C'" extend slightly below ceiling 3 and are not in contact with dichroic light exiting surface 15. However, the vertical extent of lamellae 13A'" to 13C'" is selected such that in combination with side wall $7_i$, all direct light will interact either with lamellae 13A'" to 13C'" (i.e. be transmitted) or side wall $7_i$ (e.g. being reflected or diffused).

The lamellae arrangement of FIG. 12D is a combination of the embodiments of FIGS. 12B and 12C. Lamellae 13A"" to 13C"" extend completely below the plane of ceiling 3 (at some distance d). They are, for example, reflective as schematically illustrated. Dichroic light exiting surface 15 extends within the plane of ceiling 3 and lamellae 13A"" to 13C"" are not in contact with dichroic light exiting surface 15. To cover essentially the complete directional light portion with light interacting lamellae, the lamellae arrangement is displaced with respect to dichroic light exiting surface 15 along center light beam direction 21.

As can be seen in FIGS. 12A to 12D, when the lamellae touch the dichroic light exiting surface, the direct light affected area associated with a neighboring lamella is the region between two consecutive lamellae. In contrast, when the lamellae begin at some distance from the dichroic light exiting surface, the affected direct light providing areas are displaced in dependence of the local luminous intensity distribution of direct light.

Figure 13:
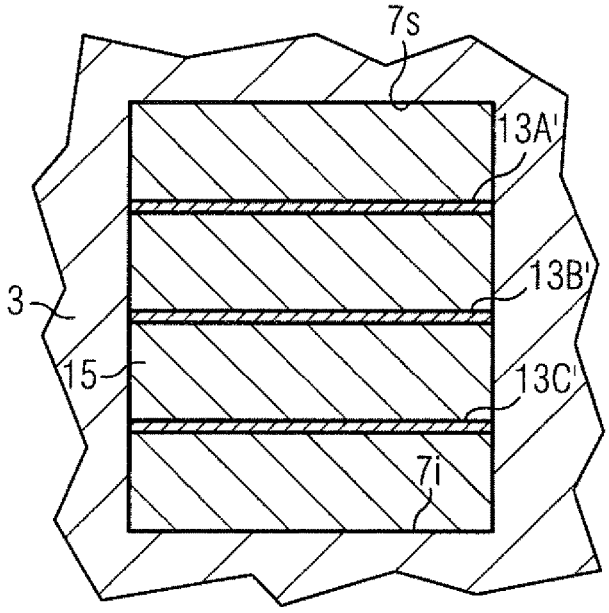
FIG. 13 illustrates a front view of a further exemplary embodiment of a lamellae based lighting system.

FIG. 13 illustrates a bottom up view onto dichroic light exiting surface 15 in the embodiment of FIG. 12A. In the case of FIG. 12A, lamellae 13A', 13B', 13C' extend (vertical), i.e. orthogonal to dichroic light exiting surface 15. Accordingly, only the bottom faces 67 of lamellae 13A', 13B', 13C' are seen. In-between the lamellae 13A', 13B', 13C', the blue scattered light reaches the observer.

Figure 14A:
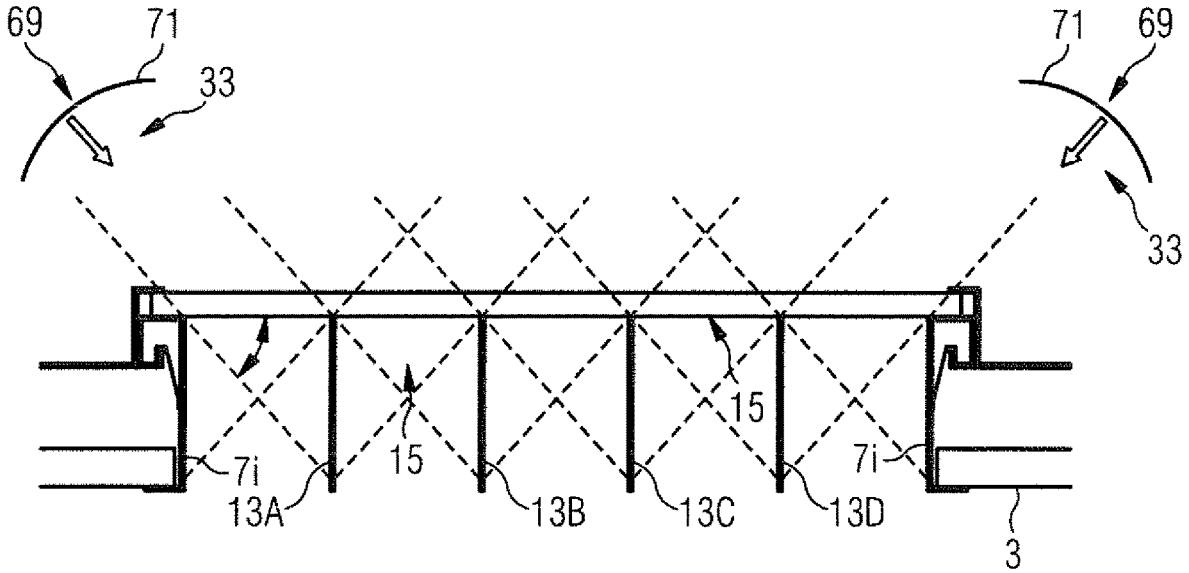
FIGS. 14A and 14B illustrate a further exemplary embodiment of a lamellae based lighting system.
Figure 14B:
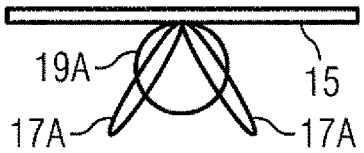

In some embodiments, more than one light sources are used to illuminate the dichroic light exiting surface. As shown in FIG. 14A, two light sources 69 are used in an embodiment similar to FIG. 12A. Light sources 69 are positioned at the sides of Rayleigh-diffuser panel 20 and mirrors 71 are used to redirect light beams 33 onto Rayleigh-diffuser panel 20 from opposing sides. For example, light sources 69 and mirrors 71 are mirror symmetrically arranged at opposing ends of the dichroic light exiting surface. Thereby, illumination of the Rayleigh-diffuser panel 20 from both sides is achieved, which may increasing the homogeneity of the diffused light emission. In that case, however, both sides of the lamellae 13A to 13D and both opposing side walls $7_i$ are at least partly directly illuminated. FIG. 14B illustrates schematically the luminous intensity distributions 17A, 19A for direct light (two peaks) and diffused light as it is emitted from dichroic light exiting surface 15.

Referring to FIGS. 15A and 15B, in some embodiments of the lighting system, a large area light source allows, for example, a structural incorporation of the light source and the panel in a single unit. Exemplary configurations of large area light sources are disclosed, for example, in the not yet published PCT/EP2015/069790 filed on 28 Aug. 2015, by the same applicants, which is incorporated herein by reference. Also in that case, the transmitted (directed non-diffused) component (directional light portion) and the diffused light portion, formed by scattered light (diffused light) are generated and emitted into the room from a dichroic light exiting surface of the lighting system.

In the embodiment illustrated in FIGS. 15A and 15B, such a compact dichroic light source 73 (including one or many white light sources and one or more diffuser units) provides a directional light portion, which may be emitted orthogonal to a dichroic light exiting surface 75 as schematically indicated by a luminous intensity distribution 74 for direct light. In addition, compact dichroic light source 73 provides a luminous intensity distribution 19A for diffused light.

As further illustrated in FIG. 15A, lamellae 77 extend across dichroic light exiting surface 75 far enough that essentially all direct light interacts with lamellae 77, being either (diffuse) transmitted or (diffuse) reflected. Exemplarily, the development of the luminous intensity distribution for two diffuse reflections is indicated for the direct light by luminous intensity distribution 74' and 74".

FIG. 15B illustrates again a bottom up view onto lamellae 77 illuminated from behind by compact dichroic light source 73. Dichroic light exiting surface 75 cannot be seen. An observer will perceive centrally above a limited bright lit-up region 79 surrounded from the diffuse (blue) light. The size is defined in particular from any diffuse interaction (transmission or reflection). Only when looking from the side though the lamellae configuration, dichroic light exiting surface 75 (the diffused emitted light) can be seen that is directly emitted from dichroic light exiting surface 75 between lamellae 77.

It is again noted that in line with the optical concepts disclosed in the above mentioned disclosures, the position of limited bright lit-up region 79 on the exit side of the appearance affecting optical system depends on the viewing angle and will therefore move across the exit side while e.g. crossing the range of the directional light portion of the lighting system.

Figure 16:
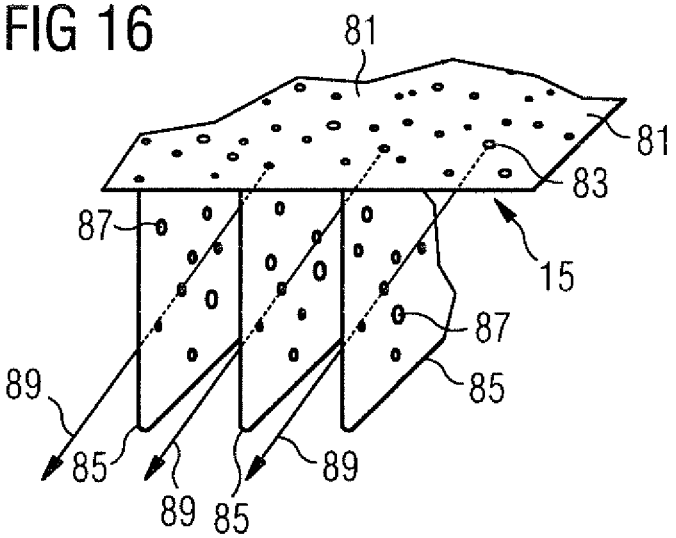
FIG. 16 illustrate an exemplary embodiment of a sequence of planar lamellae.

FIG. 16 illustrates schematically the difference between an affected direct light providing area 81 and unaffected direct light providing areas 83 exemplarily for lamellae 85 with holes 87 through which direct light 89 can pass without interaction with a lamella 85. As can be seen, for holes 87, unaffected direct light providing areas 83 are widely distributed across dichroic light exiting surface 15. Moreover, depending on the relative arrangement, not all holes 87 may result in an unaffected direct light providing area 83 because passing direct light may be impinge onto another lamella.

Figure 17A:
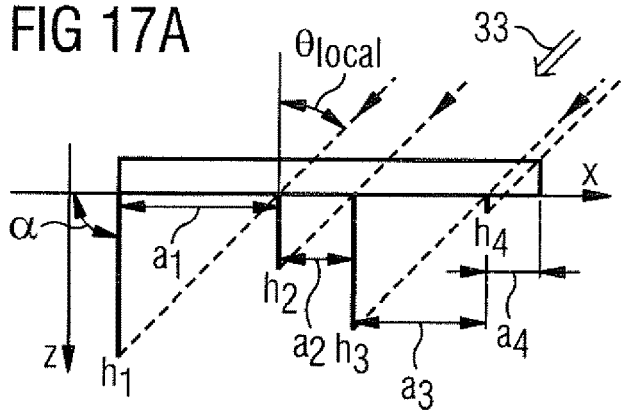
FIGS. 17A to 17C illustrate the concept of free-form lamellae systems.
Figure 17B:
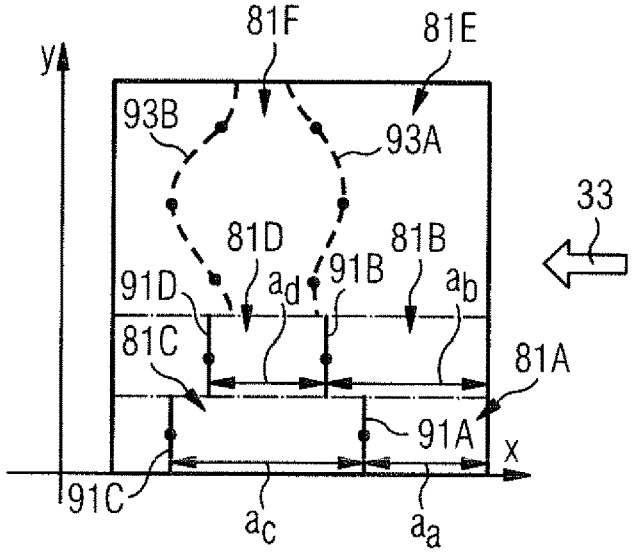
Figure 17C:
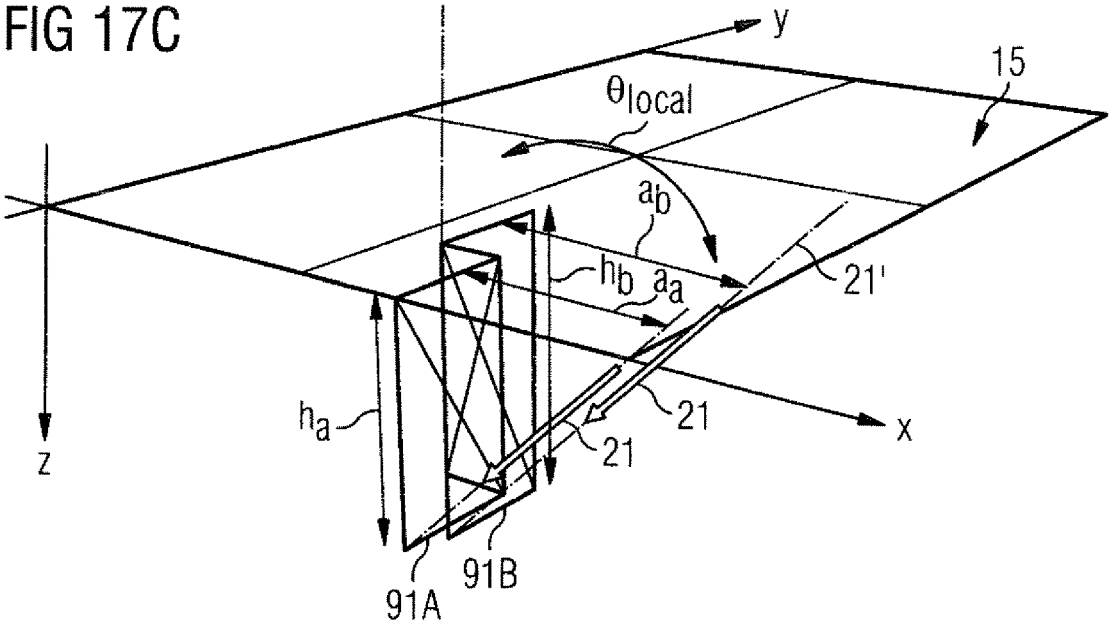

FIGS. 17A to 17C illustrate the relation between the direct light illuminated surface regions of the surface of the structural elements and the affected direct light providing areas of the dichroic light exiting surface. In particular, the relation is governed by the local projections of the dichroic light exiting surface and the structural element onto the extent of the directional light portion defined by the directed angular luminous intensity distribution. For a lamella-type structural element, the relation depends on an incidence angle $\theta_{local}$ of the local main direct light rays, an orientation angle $\alpha$ of orientation of the lamella with respect to the dichroic light exiting surface, and a length of the lamella.

FIG. 17A illustrates a linear extent $a_1$, $a_2$, $a_3$, $a_4$ of an affected direct light providing area between neighboring structural elements of local heights $h_1$, $h_2$, $h_3$, $h_4$. It will be acknowledged that to achieve the desired effect on the directional light portion, a plurality of geometries can be implemented.

For example, FIG. 17B illustrates a step-wise configuration of linear lamellae 91A to 91D. The size of affected direct light providing areas 81A to 81D, specifically their extent in the plane of incidence $a_a$, $a_b$, $a_c$, $a_d$ determines their extent into the directional light portion, e.g. their local height. FIG. 17C illustrates lamellae 91A and 91B in a perspective view, thereby illustrating their respective heights $h_a$, $h_b$ and respective extents in the plane of incidence $a_a$, $a_b$.

FIG. 17B illustrates further a wave-like shaped lamella 93A, 93B, which may have the same optical effect with similar requirements on the local height depending on the local extent of respective affected direct light providing areas 81E, 81F, specifically their extent in the plane of incidence.

FIGS. 18A, 18B and FIGS. 19A, 19B illustrate exemplary configurations of appearance affecting optical systems 95A, 95B that use height variations for the case of linear lamellae and curved lamellae, respectively.

Figure 18A:
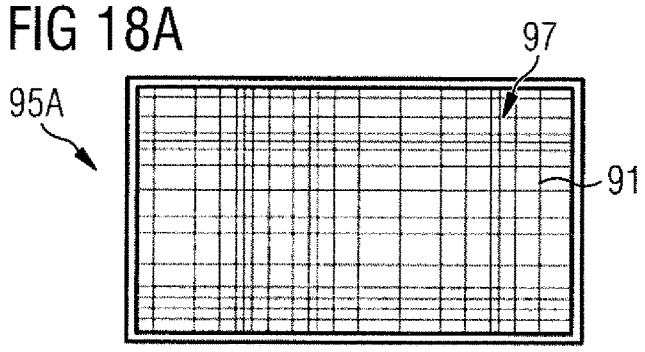
FIGS. 18A to 21B illustrate further exemplary configurations of appearance affecting optical systems.
Figure 18B:
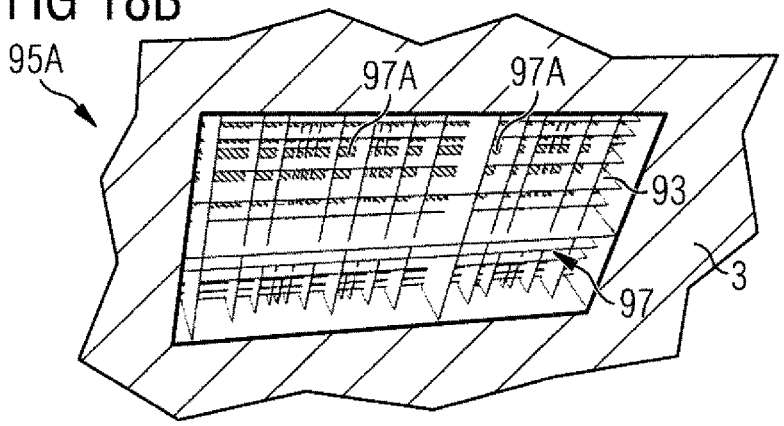

Specifically, FIGS. 18A and 18B illustrate appearance affecting optical system 95A formed of a grid structure 97 of linear lamellae 91 in a bottom-up view and a perspective view of an installation within ceiling 3. Grid structure 97 delimits rectangular dichroic light exiting areas of the dichroic light exiting surface. Depending on the viewing angle, only a portion of those dichroic light exiting areas of the dichroic light exiting surface can be seen (shaded dichroic light exiting surface regions 97A in FIG. 19A). As can be further seen, the extent of each lamella 91 with respect to the dichroic light exiting surface varies with the distance between lamellae 91 (in direction of the incident light beam). Further grid structures may form generally a distribution of diffused light passages delimited by transmitting/reflecting walls/surfaces of the structural elements such as hollow tube elements, e.g. circular pipe structure, a wall structure with polygon openings such as rectangular, square, hexagonal (honeycomb structures) and a freeform grid with free form diffused light passages as shown in FIG. 18A.

Figure 19A:
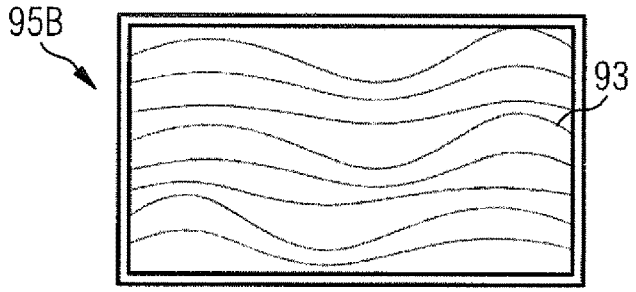
Figure 19B:
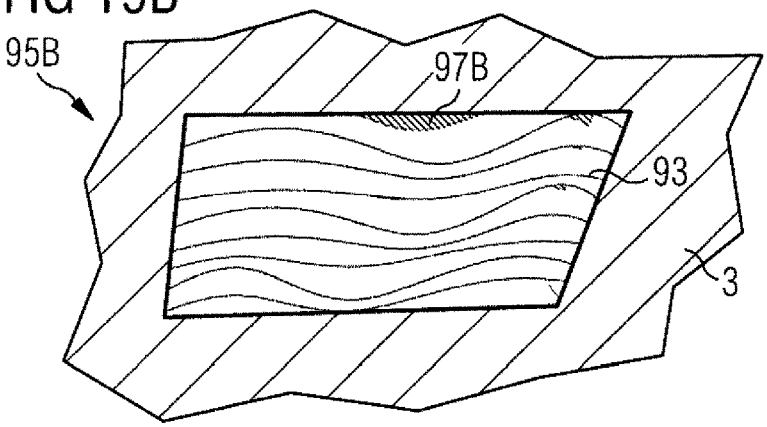

Similarly, FIGS. 19A and 19B illustrate appearance affecting optical system 95B formed of wave-like shaped lamellae 93 in a bottom-up view and a perspective view of an installation within ceiling 3. Wave-like shaped lamellae 93 delimit arbitrary shaped dichroic light exiting areas of the dichroic light exiting surface. Depending on the viewing angle, only a portion of those light exiting areas of the dichroic light exiting surface can be seen (e.g. shaded dichroic light exiting surface regions 97B in FIG. 19B). As can be further seen, the extent of each lamella 93 from the dichroic light exiting surface varies, however, for esthetic reasons. To achieve the herein disclosed task of avoiding that an observer will be able to look undisturbed into the light source, lamella 93 have, however, a respective minimum extent with respect to the dichroic light exiting surface.

FIGS. 20A, 20B and FIGS. 21A, 21B illustrate further exemplary configurations of appearance affecting optical systems 99A, 99B that use—as structural elements—a, for example, arbitrary arrangement of arbitrary structures and an arbitrary arrangement of pillar elements, respectively, to provide direct light illuminated surface regions.

Figure 20A:
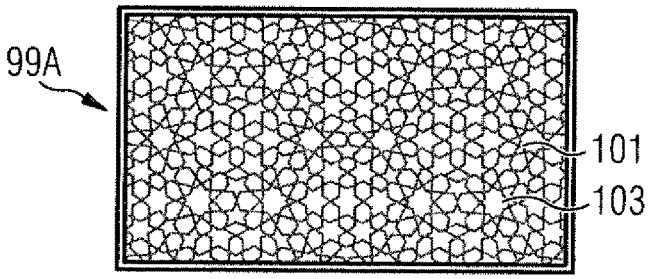
Figure 20B:
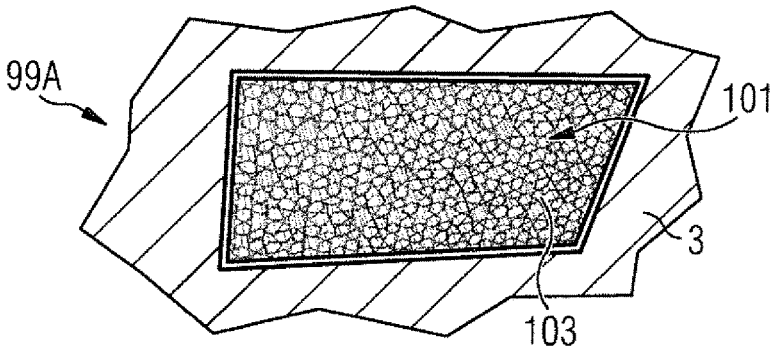

Referring to FIGS. 20A, 20B, appearance affecting optical system 99A may use, for example, a wall structure 101 to form the structural elements configured to form (to some degree) arbitrary diffused light passages 103 with e.g. polygonal cross-sections. For diffused light passages 103, wall structure 101 may provide reflective, diffuse reflective, and/or diffuse transmitting sidewalls, depending on the type of light interaction that is used for avoiding that an observer is able to look undisturbed into the light source. A respective minimum extent of wall structure 101 with respect to the dichroic light exiting surface is maintained. Alternative base-shapes for diffused light passages 103 comprise cylindrical or polygonal tubes.

Figure 21A:
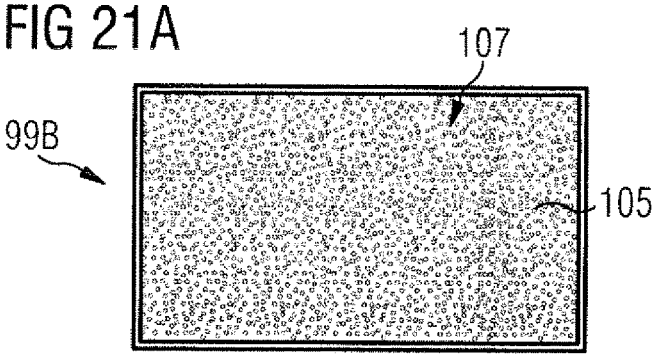
Figure 21B:
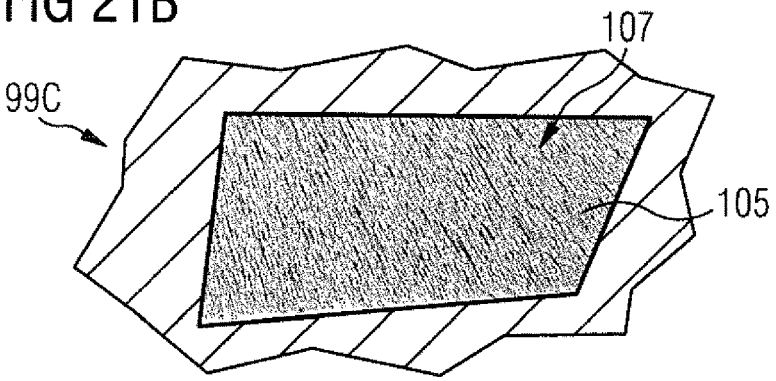

Referring to FIGS. 21A, 21B, appearance affecting optical system 99B may use, for example, an arbitrary arrangement of pillar elements 105 with e.g. a circular, oval, or polygonal cross-section. In-between pillar elements 105, diffused light passages 107 are formed with arbitrary cross-sections. Pillar elements 105 may be configured to reflect, to diffuse reflect, and/or to diffuse transmit light, depending on the type of light interaction that is used for avoiding that an observer is able to look undisturbed into the light source. A respective minimum extent of pillar elements 105 with respect to the dichroic light exiting surface is maintained. The pillar elements 105 extend between the entrance side and the exit side and form a plurality of diffused light passages 107 that comprises at least partly portions of a non-simply connected area between the entrance side and the exit side. The portions are essentially perceived as individual diffused light passages that are separated by structural elements. In this context, "simply connected" refers to a geometrical definition from topology, where a topological space is called simply-connected (or 1-connected) if it is path-connected, and every path between two points can be continuously transformed, staying within the space, into any other such path while preserving the two endpoints in question. Intuitively, as the structural elements comprise a regular or arbitrary arrangement of pillar elements across the dichroic light exiting surface, in particular across the regularly transmitted light, this means that the light passages are perceived as being separated by the structural elements.

The herein discussed aspect of local (main) light beam directions will be understood by the skilled person to refer to generally the situation of directional light propagation such as a light beam used for illuminating a Rayleigh diffuser unit. For example, locally, a directional light beam portion of direct light radiating essentially along a local main light beam direction can be understood as that, in each position (or a small region) across the light exiting surface where the direct light exits the light exiting surface, the portion of direct light exiting that position (or small region) of the light exiting surface features a local main light beam direction and an angular aperture narrower than Lambertian emission in its associated angular luminous intensity distribution.

It is noted that in addition a FWHM with respect to polar angle coordinate of a mean distribution, made by averaging along the azimuthal coordinate $\varphi$ of the luminous intensity distribution, can be smaller than 40°, 30°, 20° (while a FWHM for Lambertian emission is) 120°.

In general, herein a (local) main direction of directional light is the average over angular directions of the directional light. It can be associated with various positions of light propagation such as upstream the light exiting surface, at the entrance side of the appearance affecting optical system, after interaction with a structural element of the appearance affecting optical system, or at the exit side of the appearance affecting optical system.

In general, herein completely diffused light is associated with visible electromagnetic radiation that is emitted by a source (originates from a surface) with a luminous intensity distribution that has almost circular shape in polar coordinates, similar to a Lambertian/Lambertian-like source. In other words, each point of the source emits with no preferred directions. The Lambertian decay of the intensity with respect to the angle between the normal to a source surface and the emission direction considered ($\vartheta$), has a functional behavior with a factor $\cos(\vartheta)$. This well know decay is due to geometrical considerations and more specifically to the reduction of the solid angle subtended by a given direction while moving from the normal direction to the parallel one.

Thus, the herein discussed diffused light distribution is usually Lambertian. However, a similar effect could in principle be obtained with a narrower distribution of the diffused light portion, provided that the FWHM width of such a narrower distribution (as defined above) is larger than the FWHM of the directional light beam portion, for example, at least three, four, five, or six times larger, thereby still allowing the chromatic separation at large angles.

For completeness, in relation to diffuse light, directional light means herein a visible electromagnetic radiation emitted by a source (that can be a fictitious one, e.g. the wave front upstream the directional light itself) characterized by a luminous intensity distribution showing a standard deviation, with respect to the $\vartheta$ polar coordinate, that is at least 30% (40% or 50%) smaller than the standard deviation of the luminous intensity distribution of diffused light emitted by a Lambertian source.

Referring again to the above discussed various exemplary configurations, appearance affecting optical systems can be based on breaking up the perceived direct light into beamlets by specific shapes and/or sizes of the structural elements. The breaking up may be based on pure reflection/transmission such that the width of the luminous intensity distributions are locally not modified by the respective structural element.

In addition or alternatively, appearance affecting optical systems can be based on affecting the divergence of by spreading the direct light distribution when interacting optically with the structural elements. For example, in a spread reflection, light is reflected into a cone of light rays from surfaces of materials such as corrugated or etched metal, plastic, or glass. For example, Alanod MIRO-SILVER® 20, or Alanod surface finishing 2000 AG, Alanod MIRO-SILVER® 12 HD, or Alanod surface finishing 1200 AG HD are examples of materials that have a structured reflective surface providing a spread/diffuse reflection. In particular, the diffusion reflection from such materials is much narrower than from a Lambertian diffuser. The materials still appear as mirroring surfaces, while Lambertian diffusers would appear as a white surface, under white light illumination.

For spread reflection, the full width at half maximum of the luminous intensity distribution of the reflected light, given an input collimated beam of, for example, angular full width at half maximum smaller than 1° can be increased e.g. to 5° or more, or 10° or more, 30° or more, or 40° or more such as 20°. Similarly, the transmission through a structural element (as also through the diffuser unit) may increase the full width at half maximum of the luminous intensity distribution of the transmitted light in a similar manner, given, for example, an input collimated beam as above. For example, Holographic Light Shaping Diffusers® by Luminit with angular diffusion 5°, 10°, 20°, 30°, or 40° are exemplary diffuse transmitting materials. In the Luminit example, the diffusing properties are determined by surface properties of the material; alternatively or in addition, volumetric diffusion properties can be considered as well to affect the angular diffusion.

Generally, with respect to an appearance affecting optical system that is based at least partly on reflection, the direct light illuminated surface regions of structural elements face generally towards local main directions of associated direct light affected areas to guide the light from the entrance side to the exit side. When reflecting the direct light out of the appearance affecting optical system, an inclination angle between a local normal vector of a local section of direct light illuminated surface region and a light ray being incident with a local main direction onto that local section is larger than 0° in a direction away from the light exiting surface. Depending on the inclination angle, the direct light being incident with a local main direction will exit the lighting system with one or more reflections. Usually for illumination efficiency, the inclination angle is selected large enough (usually in a range from 10° to 80°, such as around 30°, 45°, or 60°) with respect to the directional distribution of the direct light such that most of the direct light is directed outward of the lighting system (instead of backwards onto the light emitting surface).

As mentioned above, optical properties of the surface or material of the structural elements or their configuration may allow providing a more uniform luminance distribution for the area illuminated by the lighting system. For example, the diffuse reflection or diffuse transmission will result in overlapping of direct light from two or more structural elements downstream the exit side of the appearance affecting optical system. In addition, there is some broadening of the area being directly illuminated.

Figure 22:
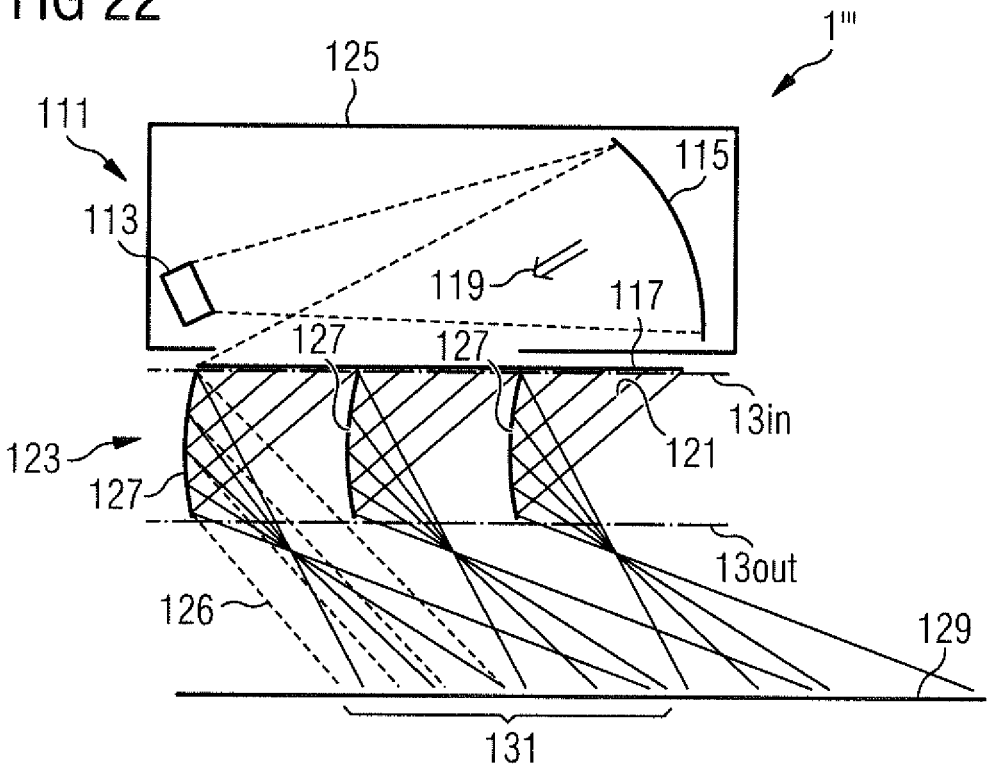
FIGS. 22 to 24 illustrate further exemplary configurations for affecting the uniformity in illumination.

Moreover, the structural elements may change the divergence of the reflected direct light as illustrated for the exemplary lighting system 1''' in FIG. 22. Lighting system 1''' comprises a lighting unit 111 with a light source 113, a collimating and folding mirror 115 and diffuser unit 117 that is illuminated by a low divergent (collimated) light beam 119. An output side of diffuser unit 117 forms a dichroic light exiting surface 121 of lighting unit 111 from which lighting unit 111 emits dichroic into an appearance affecting optical system 123. The components of lighting unit 111 may be mounted within a light tight housing 125. It is noted that the exemplary configuration of lighting unit 111 can generally be used in combination of the herein disclosed appearance affecting optical systems.

Appearance affecting optical system 123 comprises a sequence of lamellae 127 being diffusive reflective at the direct light illuminated surface regions to redirect the direct light. To further increase the uniformity of the illumination of e.g. a floor 129, lamellae 127 are non-planar such as concave (as illustrated in FIG. 22), convex or with changing curvature. Thereby, the redirected direct light is less collimated and falls onto a larger area 131 of floor 129. In FIG. 22, the concave shape results in a focus zone that is located downstream appearance affecting optical system 123. For comparison, FIG. 22 illustrates more localized illumination by light (dashed lines 126) when redirected with planar lamellae. The large spreading of the direct light reflected by lamellae 127 results in overlapping of light from neighboring lamellae 127 and thus a more uniform illumination of floor 129. Moreover, the angular spread is increased essentially without losses.

Figure 23:
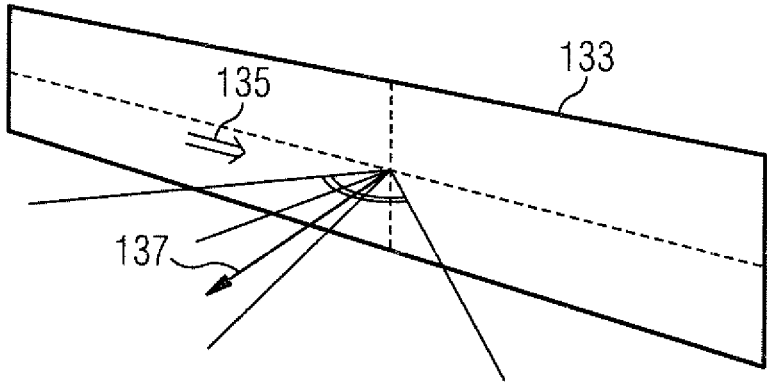

FIG. 23 illustrates a further configuration of an (exemplarily planar) lamella 133. Lamella 133 comprises an asymmetric surface structure that results in different changes in the luminous intensity distribution for different polar angles. Specifically, FIG. 23 illustrates a reflection of incoming light 135 around a local main light beam direction 137. The asymmetric surface structure is configured to increase the standard deviation with respect to the $\vartheta$ polar coordinate in a vertical plane (e.g. the plane of reflection) much less than in the orthogonal plane thereto. In other words, the diffuse reflection enlarges the beam in the plane orthogonal to the reflection plane more than it enlarges the beam in the reflection plane, in the illustrated example. In that case, diffuse reflected light broadens along the lamella 133 (increasing the uniformity in this direction) while it stays more narrow when propagating downwards towards the exit side of a respective appearance affecting optical system. The configuration with enlarged diffuse reflection in the reflection plane with respect to reflection in the orthogonal plane is similarly possible. A respective asymmetric surface structure may be achieved by asymmetric, for example elliptical, imprints of the surface of the lamella, or can be a property of the material constituting the lamella itself. The directionality of the asymmetry may vary for different areas of a lamella or different configurations of an appearance affecting optical system. Similarly, asymmetric diffuse transmission may be used. As exemplary materials regarding the asymmetric broadening of diffuse reflection, asymmetric Alanod material diffuse reflecting mirrors can be considered, such as Alanod MIRO-SILVER® 7 with surface finishing 5000 AG. For the transmission case, elliptical diffusing film or diffusers by Luminit in the same or similar category as those previously mentioned can be considered as examples.

Figure 24:
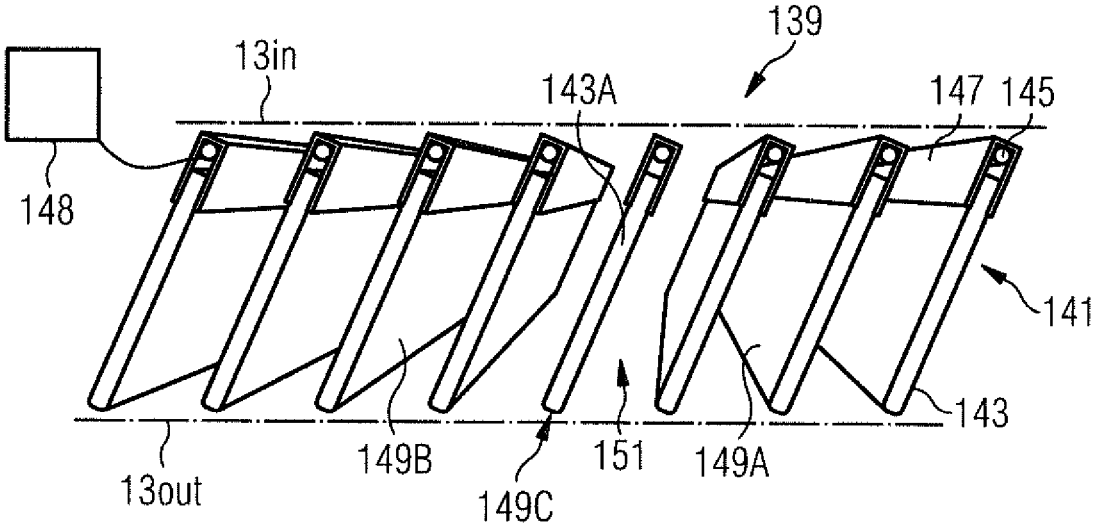

In connection with FIG. 24, a further approach for providing a more uniform luminance profile of a lighting system by use of a specific appearance affecting optical system is described. Specifically, the structural elements can be used to implement a secondary light source system. While FIG. 24 illustrates the concept for a planar lamella configuration, it is apparent that similar configurations can be implemented into the various types of structural units disclosed herein.

In FIG. 24, an exemplary cross-section of an appearance affecting optical system 139 is shown. Appearance affecting optical system 139 comprises a sequence of planar lamella units 141. Each lamella unit 141 comprises a lamella 143 and at least one supporting light source 145, exemplarily mounted to lamella 143 via a mounting track 147 (e.g. cover profile covering the at least one supporting light source 145) and electrically provided with power by a power source 148 to emit light into lamella 143. Supporting light source 145 is optically coupled to lamella 143 to emit supporting light into a body 143A of lamella 143 along its top side. Once the supporting light leaves lamella 143 it forms a supporting light portion that—in addition to the directional light portion and the diffused light portion originating from the dichromatic light exiting surface—defines the luminous intensity distribution of the lighting system. Specifically, the supporting light portion can help providing a more uniform luminance in the "to be illuminated" area.

Body 143A of lamella 143 and in particular its surfaces at the sides and the bottom can be configured optically to couple the light out of body 143A in a desired manner.

For example, side surfaces 149A, 149B may be configured to reflect the light, i.e. to maintain the light in body 143A until it reaches a bottom surface 149C. From there, it may be emitted in a diffuse or to some extent angularly limited manner, thus forming lit up stripes when looking at appearance affecting optical system 139.

In addition or alternatively, one or both sides may be configured to allow some leakage of light from within body 143A through the sides into diffused light passages 151. Accordingly, the leaking light will affect the appearance of the side(s) of lamellae 143. In addition, body 143A may comprise e.g. scattering centers that scatter the light out of body 143A in a volumetric or surface light guide extraction configuration. For example, the lamellae may be configured as a Rayleigh diffuser panel.

The color of the light source can additionally be selected to affect or not to affect the appearance of the lighting system. For example, the light source may be white LEDs, thereby not affecting the perceived color itself. Alternatively, the light source may be blue LEDs to add to the blue appearance of the structural elements, assuming that at least some light emerges from their sides.

For example, the secondary light source system features a CCT that is at least 1.1, or at least 1.2, or at least 1.5 times lower than the first correlated color temperature of the directional light portion of direct light.

In another embodiment, each structural element comprises a plurality of extracting optical components configured to emit light from such structural element, such that at least 60% such as at least 80% of the radiant flux of light exiting the structural element is not directed toward the light exit window, e.g. at least 60% such as at least 80% of the radiant flux of light exiting the structural element propagates in the hemisphere, which does not comprise the exit window.

In another embodiment, the secondary light source comprises a white tunable emitter. The white tunable emitter can be tuned in intensity and/or spectral emission properties, e.g. light output CCT. In the case of tunable CCT, the light emitted by the secondary light source can be tuned in the range 2000K to 10000K, such as 3000K to 7000K.

In another embodiment, the radiant or luminous flux of light exiting the structural element can reach at least 1.2 times, such as at least 1.5 times, such as at least 2 times, such as at least 3 times the total radiant or luminous flux emerging from exit window.

In another embodiment the secondary light sources, for example LED sources, are hidden by a cover profile. The cover profile can for example be reflecting and/or diffusing. The shape of the cover profile could in some embodiments be similar to the shape of clouds.

Generally, the light source can be, for example, a cool white light source. Exemplary embodiments of light sources may comprise LED based light emitters or discharge lamp based light emitters or hydrargyrum medium-arc iodide lamp based light emitters or halogen lamp based light emitters and respective optical systems downstream of the respective light emitter.

Referring generally to the dichroic features of the light provided by the herein disclosed lighting systems, for example, the diffuse light portion may comprise a portion of the total incident energy in the range from 5% to 70%, such within the range from 7% to 50%, or even in the range from 10% to 30%, or within the range from 15% to 20%. The average CCT of the diffuse light portion may be significantly higher than the average correlated color temperature CCT of the directional light portion. For example, it may be higher by a factor of 1.2, or 1.3, or 1.5 or more. In general, the diffuser unit may not absorb significantly incident light.

As it is apparent to the skilled person, depending on the specific interaction of the Rayleigh diffuser with the incident light, the color and/or CCT of the directional and diffused light portions may be affected in various manners.

For example, the directional and diffused light portions may be separated in the CIE 1976 (u',v') color space by, at least 0.008 such as at least 0.01, 0.025, or 0.04, where the color difference $\Delta u'v'$ is defined as the Euclidean distance in the u'v' color space. In particular for sun-imitation configurations, the illuminating light beam CCT of the sun imitation may be close to the Planckian locus (e.g. in the range from 800 K to 6 500 K). In some embodiments the second color may correspond to u'v' points with a maximum distance from the Planckian locus of e.g. 0.06. In other words, a distance from the Planckian locus is, for example in the range from 800 K to 6500 K, given by $\Delta u'v' \leq 0.060$. For additional chromatic features, it is referred the embodiments described in the above mentioned applications.

The chromatic diffusing layer may comprise a plurality of nanoscale elements embedded in a transparent matrix. The nanoscale elements and the transparent matrix have a difference in the refractive index. That difference in the refractive index, the size distribution of the nanoscale elements embedded in the matrix, and the number of nanoscale elements per unit surface area are, for example, selected such that a transmittance is provided that is larger in the red (in the meaning of longer wavelengths of an incident broad spectrum) than in the blue (in the meaning of shorter wavelengths of an incident broad spectrum). Thus, the chromatic diffusing layer is constructed such that it preferentially scatters short-wavelength components of visible incident light with respect to long-wavelength components of visible incident light.

Nanostructure-based Rayleigh-like diffusing material used in the diffuser panel may comprises a solid matrix of a first material (e.g. resins having excellent optical transparency), wherein nanoscattering centers such as nanoparticles or nanodroplets of a second material (organic or inorganic nanoparticles such as ZnO, TiO2, SiO2, Al2O3 and similar or liquid crystal droplets) are dispersed. To achieve the scattering, the refractive indexes of the two materials are different, and this mismatch on the refractive index on the nano-scale is responsible of the Rayleigh-like scattering phenomenon. The absorption of the first and the second material in the visible wavelength range usually can be considered negligible. Moreover, the diffuser panel may be uniform, in the sense that, given any point of the diffuser panel, the physical characteristics of the panel in that point does not depend on the position of that point. An effective diameter d of the nanostructure (nanoscattering centers) falls within the range [5 nm-50 nm], such as [10 nm-350 nm], or even [40 nm-180 nm], or [60 nm-150 nm], where the effective diameter d is the diameter of the equivalent spherical particle, namely the effective diameter spherical particle having similar scattering properties as the aforementioned nanoparticles. As mentioned above, larger elements may be provided within the diffuser unit with dimensions outside that Rayleigh-like scatterer range but those elements may not affect the Rayleigh-like feature and, for example, only contribute to forming a low-angle scattering cone around the specular reflection/pure transmission.

Diameter, refractive index mismatch and areal density (number per square meter) of the nanoparticles are the parameters that define the cross section of the scattering phenomenon in the chromatic panel. In addition, the amount of the impinging light scattered from the chromatic panel increases by increasing one of the parameters mentioned above. In order to simplify the description we can consider just the regular transmittance property $T(\lambda)$ of the material at a certain wavelength. Herein, as defined in the Standard Terminology of Appearance, ASTM international, E 284-09a, the transmittance is in general the ratio of the transmitted flux to the incident flux in the given conditions. The regular transmittance $T(\lambda)$ is the transmittance under the undiffused angle, i.e. the angle of incidence. In the context of the present disclosure, for a given wavelength and a given position on the chromatic diffusing layer, the regular transmittance is intended for non-polarized incident light with an incident angle corresponding to the main light beam propagation.

Regarding the transmission configurations as the one described in FIG. 1 the regular transmittance for the blue T[450 nm] may be in general within the range [0.05-0.9]. In particular in some embodiments aiming at a pure clear sky the range would be [0.3-0.9], such as [0.35-0.85] or even [0.4-0.8]; in the embodiments aiming at a Nordic sky the range would be [0.05-0.3], such as [0.1-0.3] or even [0.15-0.3]. Since the transmittance measurement is a feasible way to evaluate the optical properties of the presented materials, herein this approach is applied similarly to the reflective chromatic stratified panels.

Considering that in the reflection configuration described in the above mentioned applications, the nano-loaded scattering coating is crossed twice by an impinging light (due to the presence of the mirror), in order to obtain comparable transmittance data with respect to the transmission configuration, the mirror coating has to be removed. The regular transmittance for the blue T[450 nm] of a chromatic stratified panel before the mirroring of the outer surface may be in general within the range [0.2-0.95]. In particular in some embodiments aiming at a pure clear sky the range would be [0.55-0.95], such as [0.6-0.92] or even [0.62-0.9]; in the embodiments aiming at a Nordic sky the range would be [0.2-0.55], such as [0.3-0.55] or even [0.4-0.55]. The transmittance of a pure clear sky is higher than the one of a Nordic sky. For example, considering the same light source impinging on two chromatic stratified panels, one in the pure clear sky configuration and one in Nordic configuration, the chromatic properties in the sun-sky effect will be different. The sky in the Nordic configuration will be whitish compared to the one in the pure clear sky. The sun in the Nordic configuration will be more yellow than the one in the pure clear sky.

The chromatic effect is further based on the ratio m between the particle and host medium refractive indexes (with $$m \equiv \frac{n_p}{n_h})$$

may be in the range 0.5≤m≤2.5 such as in the range 0.7≤m≤2.1 or 0.7≤m≤1.9.

The chromatic effect is further based on the number of nanoscattering centers per unit area seen by the impinging light propagating in the given direction as well as the volume-filling-fraction f. The volume filling fraction f is given by $$f = \frac{4}{3}\pi\left(\frac{d}{2}\right)^3 \rho$$

with ρ [meter$^{-3}$] being the number of particles per unit volume. Filling fractions can cover a large range such as f≤0.4, such as f≤0.1, for solid particles within a matrix or larger values off for liquid crystal embodiments (f up to 0.7 and more).

The chromatic effect is further based on a number N of nanoscattering centers per unit area of the chromatic diffusive layer in dependence of an effective particle diameter D=d $n_p$. Thereby, d [meter] is the average particle size defined as the average particle diameter in the case of spherical particles, and as the average diameter of volume-to-area equivalent spherical particles in the case of non-spherical particles, as defined in [T. C. GRENFELL, AND S. G. WARREN, "Representation of a non-spherical ice particle by a collection of independent spheres for scattering and absorption of radiation". Journal of Geophysical Research 104, D24, 31,697-31,709. (1999)]. The effective particle diameter is given in meters or, where specified in nm.

In some embodiments:

$$N \geq N_{min} = \frac{7.13\times10^{-29}}{D^6}\left|\frac{m^2+2}{m^2-1}\right|^2 \text{ [meters}^{-2}\text{]},$$

(D given in [meters]) and $$N \leq N_{max} = \frac{2.03\times10^{-27}}{D^6}\left|\frac{m^2+2}{m^2-1}\right|^2 \text{ [meters}^{-2}\text{]}$$

Considering the transmission configuration:

For example, for embodiments aiming at simulating the presence of a pure clear sky, $$N \geq N_{min} = \frac{7.13\times10^{-29}}{D^6}\left|\frac{m^2+2}{m^2-1}\right|^2 \text{ [meters}^{-2}\text{]},$$

(D given in [meters]) and N≤

$$N_{max} = \frac{8.15\times10^{-28}}{D^6}\left|\frac{m^2+2}{m^2-1}\right|^2 \text{ [meters}^{-2}\text{]}$$

such as $$N \geq N_{min} = \frac{1.10\times10^{-28}}{D^6}\left|\frac{m^2+2}{m^2-1}\right|^2 \text{ [meters}^{-2}\text{]}$$

and $$N \leq N_{max} = \frac{7.11\times10^{-28}}{D^6}\left|\frac{m^2+2}{m^2-1}\right|^2 \text{ [meters}^{-2}\text{]},$$

more specifically $$N \geq N_{min} = \frac{1.51\times10^{-28}}{D^6}\left|\frac{m^2+2}{m^2-1}\right|^2 \text{ [meters}^{-2}\text{]}$$

and $$N \leq N_{max} = \frac{6.20\times10^{-28}}{D^6}\left|\frac{m^2+2}{m^2-1}\right|^2 \text{ [meters}^{-2}\text{]}.$$

In other embodiments aiming at simulating a Nordic sky, $$N \geq N_{min} = \frac{8.15\times10^{-28}}{D^6}\left|\frac{m^2+2}{m^2-1}\right|^2 \text{ [meters}^{-2}\text{]},$$

(D given in [meters]) and $$N \leq N_{max} = \frac{2.03\times10^{-27}}{D^6}\left|\frac{m^2+2}{m^2-1}\right|^2 \text{ [meters}^{-2}\text{]}$$

such as $$N \geq N_{min} = \frac{8.15\times10^{-28}}{D^6}\left|\frac{m^2+2}{m^2-1}\right|^2 \text{ [meters}^{-2}\text{]}$$

and $$N \leq N_{max} = \frac{1.56\times10^{-27}}{D^6}\left|\frac{m^2+2}{m^2-1}\right|^2 \text{ [meters}^{-2}\text{]},$$

more specifically $$N \geq N_{min} = \frac{8.15\times10^{-28}}{D^6}\left|\frac{m^2+2}{m^2-1}\right|^2 \text{ [meters}^{-2}\text{]}$$

and $$N \leq N_{max} = \frac{1.28\times10^{-27}}{D^6}\left|\frac{m^2+2}{m^2-1}\right|^2 \text{ [meters}^{-2}\text{]}.$$

Considering the reflection configuration:

For example, for embodiments aiming at simulating the presence of a pure clear sky, $$N \geq N_{min} = \frac{3.47 \times 10^{-29}}{D^6}\left|\frac{m^2+2}{m^2-1}\right|^2 \text{ [meters}^{-2}\text{]},$$

(D given in [meters]) and $$N \leq N_{max} = \frac{4.05 \times 10^{-28}}{D^6}\left|\frac{m^2+2}{m^2-1}\right|^2 \text{ [meters}^{-2}\text{]}$$

such as $$N \geq N_{min} = \frac{5.65 \times 10^{-29}}{D^6}\left|\frac{m^2+2}{m^2-1}\right|^2 \text{ [meters}^{-2}\text{]}$$

and $$N \leq N_{max} = \frac{3.46 \times 10^{-28}}{D^6}\left|\frac{m^2+2}{m^2-1}\right|^2 \text{ [meters}^{-2}\text{]},$$

more specifically $$N \geq N_{min} = \frac{7.13 \times 10^{-29}}{D^6}\left|\frac{m^2+2}{m^2-1}\right|^2 \text{ [meters}^{-2}\text{]}$$

and $$N \leq N_{max} = \frac{3.13 \times 10^{-28}}{D^6}\left|\frac{m^2+2}{m^2-1}\right|^2 \text{ [meters}^{-2}\text{]}.$$

In other embodiments aiming at simulating a Nordic sky, $$N \geq N_{min} = \frac{4.05 \times 10^{-28}}{D^6}\left|\frac{m^2+2}{m^2-1}\right|^2 \text{ [meters}^{-2}\text{]},$$

(D given in [meters]) and $$N \leq N_{max} = \frac{1.03 \times 10^{-27}}{D^6}\left|\frac{m^2+2}{m^2-1}\right|^2 \text{ [meters}^{-2}\text{]},$$

such as $$N \geq N_{min} = \frac{4.05 \times 10^{-28}}{D^6}\left|\frac{m^2+2}{m^2-1}\right|^2 \text{ [meters}^{-2}\text{]}$$

and $$N \leq N_{max} = \frac{7.71 \times 10^{-28}}{D^6}\left|\frac{m^2+2}{m^2-1}\right|^2 \text{ [meters}^{-2}\text{]},$$

more specifically $$N \geq N_{min} = \frac{4.05 \times 10^{-28}}{D^6}\left|\frac{m^2+2}{m^2-1}\right|^2 \text{ [meters}^{-2}\text{]}$$

and $$N \leq N_{max} = \frac{6.37 \times 10^{-28}}{D^6}\left|\frac{m^2+2}{m^2-1}\right|^2 \text{ [meters}^{-2}\text{]}.$$

In general, any of the following factors may be applied as upper or lower limit, including that value or excluding that value respectively in the term $$\frac{\text{factor}}{D^6}\left|\frac{m^2+2}{m^2-1}\right|^2:$$

| factor (e.g. for Nmin) | factor (e.g. for Nmax) |
|---|---|
| 4.24e−29 | 9.27e−28 (1.04e−27) |
| 8.99e−29 | 6.48e−28 (7.27e−28) |
| 2.79e−28 | 3.69e−28 |
| 3.69e−28 (4.14e−28) | 2.79e−28 |
| 4.85e−28 (5.44e−28) | 2.06e−28 |
| 9.27e−28 (1.04e−27) | 1.21e−27 |
| 9.48e−28 (1.06e−27) | 1.17e−27 (1.31e−27) |
| 9.72e−28 (1.09e−27) | 1.07e−27 (1.20e−27) |

With respect to those physical parameters and their general interplay, it is again referred to WO 2009/156348 A1.

As illustrated herein, the scattering aspects are related to a relative refractive index between nanoparticles and a host material. Accordingly, nanoparticles may refer to solid particles as well as optically equivalent liquid or gaseous phase nanoscale elements such as generally liquid or gas phase inclusions (e.g. nanodroplets, nanovoids, nanoinclusion, nanobubbles etc.) having nanometric size and being embedded in the host materials. Exemplary materials that comprise gas phase inclusion (nanovoids/nanopores) in a solid matrix include aerogels that are commonly formed by a 3 dimensional metal oxides (such as silica, alumina, iron oxide) or an organic polymer (e.g. polyacrylates, polystyrenes, polyurethanes, and epoxies) solid framework hosting pores (air/gas inclusions) with dimension in the nanoscale. Exemplary materials that comprise liquid phase inclusions include liquid crystal (LC) phases with nanometric dimensions often referred to as liquid phase including nanodroplets that are confined in a matrix that commonly may have a polymeric nature. In principle, there is a large variety of LCs commercially available, e.g. by Merck KGaA (Germany). Typical classes of liquid crystal may include cyanobiphenyls and fluorinated compounds. Cyanobiphenyls can be mixed with cyanoterphenyls and with various esters. A commercial example of nematic liquid crystals belonging to this class is "E7" (Licrilite® BL001 from Merck KGaA). Furthermore, liquid crystals such as TOTN404 and ROTN-570 are available from other companies such as Hoffman-LaRoche, Switzerland.

With respect to LC, an anisotropy in refractive index may be present. This may allow to use liquid crystal droplets dispersed in a solid transparent host material as scattering particles in a nanosize range (e.g. for Rayleigh-like scattering). Specifically, one can set a contributing relative index of refraction by changing a voltage applied across the liquid crystal droplets, e.g. using a sandwich structure of an polymer dispersed liquid crystal (PDLC) layer provided in between electrical contacts (such as ITO PET films or ITO glass sheets) in a sandwich structure and applying a voltage across the PDLC layer using a power source. Specifically, creating an electric field aligns the liquid crystal orientations within distinct nanodroplets to some extent. For further details, it is referred to the international patent application entitled "TUNABILITY IN SUN-LIGHT IMITATING LIGHTING SYSTEMS", filed on the same day herewith by the same applicants, which is incorporated by reference herein.

Although, herein the Rayleigh-like scattering is primarily disclosed in connection with panel structures, in view of the cited disclosures, it is apparent that also other configuration such as film, coating, sandwich structures can apply in a planar or curved, transmitting or reflecting manner.

Although the preferred embodiments of this invention have been described herein, improvements and modifications may be incorporated without departing from the scope of the following claims.

The invention claimed is:

1. A lighting system comprising:

a lighting unit including a light source and a dichroic light exiting surface, wherein the lighting unit is configured for emitting dichroic light from the dichroic light exiting surface and the emitted dichroic light includes a directional light portion of direct light having a first correlated color temperature, wherein the direct light from a specific location of the dichroic light exiting surface is emitted with a directed angular luminous intensity distribution with a local peak, which defines a local main direction of direct light emitted from that specific location; and a diffused light portion of diffused light having a second correlated color temperature, which is larger than the first correlated color temperature, wherein the diffused light is emitted for a specific location of the dichroic light exiting surface with a diffuse angular luminous intensity distribution; and an appearance affecting optical system including an entrance side located at the side of the dichroic light exiting surface, an exit side opposite to the entrance side, and a plurality of structural elements that comprise surfaces that extend in-between the entrance side and the exit side, delimit a plurality of diffused light passages, and comprise direct light illuminated surface regions, which are subject to the illumination with direct light from respectively associated affected direct light providing areas of dichroic light exiting surface, wherein the affected direct light providing areas cover at least 70% of the dichroic light exiting surface, and the direct light from at least one affected direct light providing area and diffused light propagate within at least one of the diffused light passages.

2. The lighting system of claim 1, wherein at least one of the diffused light passages is configured such that some of the direct light passes from unaffected direct light providing areas of the light exiting surface to the exit side without interacting with any structural element and wherein the unaffected direct light providing areas cover up to 30% of the area of the dichroic light exiting surface; and/or at least one of the diffused light passages is configured as a void volume that allows looking at a portion of the light exiting surface under a light passage specific range of observation angles and seeing diffused light propagating through the light passage some of which passing from the dichroic light exiting surface to the exit side without interacting with any structural element, wherein at least one of the diffused light passages is at least partially delimited by respective direct light illuminated surface regions.

3. The lighting system of claim 1, wherein the direct light emitted from a specific location of the dichroic light exiting surface comprises a local main direct light ray that originates from that specific location in the local main direction and the relation between a direct light illuminated surface region and an associated affected direct light providing area is given by the condition that those locations on the dichroic light exiting surface form the associated affected direct light providing area from which local main direct light rays, which originate in the respective local main directions, propagate through the void of a respective diffused light passages until they impinge, as a first optical interaction, onto the structural element on which the respective direct light illuminated surface region is formed.

4. The lighting system of claim 1, wherein the directed angular luminous intensity distribution associated with a specific location of the dichroic light exiting surface has a full width half maximum that is about or smaller than 40°, 30°, or 20°, and with respect to a specific plane is about or smaller than 40°, 30°, or 20°, and/or the diffuse angular luminous intensity distribution at a second correlated color temperature is a Lambertian or Lambertian-like intensity distribution.

5. The lighting system of claim 1, wherein the structural elements, and the direct light illuminated surface regions, each extend within a local depth range defined in a normal direction with respect to a dichroic light exiting surface and lateral width range defined in a parallel direction with respect to a dichroic light exiting surface such that at least 60%, at least 70%, or at least 80% of the radiant flux of the directional light portion is incident on direct light illuminated surface regions, and/or the remaining part of the directional light portion, which is not incident on direct light illuminated surface regions, is spatially distributed over the dichroic light exiting surface in a plurality of non-contiguous regions.

6. The lighting system of claim 1, wherein neighboring structural elements providing neighboring direct light illuminated surface region are associated with neighboring affected direct light providing areas, and/or at least one of the plurality of structural elements comprises a purely diffused light illuminated surface region close to a direct light illuminated surface region.

7. The lighting system of claim 1, wherein at least one of:

the dichroic light exiting surface comprises at least one unaffected direct light providing area from which a local main direct light ray that originates from a specific location in the local main direction passes through the appearance affecting optical system without interacting with any structural element, the dichroic light exiting surface comprises at least one diffused light area from which some diffused light passes through the appearance affecting optical system without interacting with any structural element, and wherein in particular the at least one diffused light area overlaps at least partly with one or more affected direct light providing areas and/or one or more unaffected direct light providing areas.

8. The lighting system of claim 1, wherein when two neighboring structural elements are in contact with the dichroic light exiting surface, the affected direct light providing area associated with a direct light illuminated surface region of one of the two structural elements is the area between the two structural elements, and/or 40% or less, such as 30% or less, or 20% or less of the radiant flux of the direct light passes through the appearance affecting optical system without interacting with any structural element by passing through the respective diffused light passages and/or through an opening within a structural element.

9. The lighting system of claim 1, wherein at least one side surface of at least one structural element, and the orientation and the shape of a direct light illuminated surface region, is configured as a reflective side face that guides at least a portion of the dichroic light via at least one reflection from the entrance side to the exit side, and/or the reflective side face is configured to reflect at least 60%, at least 70%, or at least 80% of the radiant flux of the directional light portion.

10. The lighting system of claim 9, wherein a local main direct light ray, which originates from a specific location within an associated affected direct light providing area in the respective local main direction, performs at least one reflection at at least one reflective side face such that the local main direct light ray is redirected at least once before exiting the appearance affecting optical system at the exit side, and/or at least one of the structural elements comprises an averted face that faces towards a one reflective side face of a directly neighboring structural element, wherein the averted face is configured to be reflective, diffuse reflective, or diffuse scattering to any light impinging thereon including diffused light and direct light.

11. The lighting system of claim 9, wherein the reflective side face is configured to have a diffusive property to provide for a quasi-specular reflection, and to reflect a light beam such that the angular content is enlarged and the perception of the light beam is spread in size compared to a pure specular reflection, and/or the reflective side face is configured to have a diffusive property when reflecting light such that an output directed angular luminous intensity distribution of the direct light after the diffusive reflection broadens with respect to an input directed angular luminous intensity distribution, wherein the feature of a local peak, which defines a reflected local main direction of direct light reflected from a specific location, is maintained and wherein the reflective side face reflects light in a manner that provides a reflected luminous intensity along a reflected main light beam direction that is greater than a reflected luminous intensity of a Lambertian diffuser in that reflected local main light beam direction.

12. The lighting system of claim 9, wherein the output directed angular luminous intensity distribution associated with a specific location on the reflective side face has a full width half maximum that increases with respect to a directed angular luminous intensity distribution prior reflection by at least 2%, at least 5%, at least 10%, or at least 100%, but increases by 50° or less, by 40° or less, or by about 30° or 20°, and/or the output directed angular luminous intensity distribution associated with a reflected local main direction has a full width half maximum in the plane of reflection that is about or smaller than 50°, 40° or less, or about 30° or 20°.

13. The lighting system of claim 9, wherein at least one of:

the reflective side face has a surface shape that reflects local main direct light into a cone of light rays around a specular reflected mean direct light direction, and has a surface of corrugated or etched metal, plastic or glass, at least one of the structural elements comprises an asymmetrically reflecting reflective side face having different degrees of diffusing for at least two orthogonal planes, and at least one of the degrees of diffusing is configured to overlap illumination from lighting system arranged next to each other to obtain a uniform illuminance.

14. The lighting system of claim 1, wherein at least one of the structural elements comprises a curvature in the incidence plane of the direct light, and/or the curvature is selected to not direct or reflect light towards the dichroic light exiting surface and/or wherein the plurality of such curved structural elements creates an increase of the full width half maximum of the directed luminous intensity distribution angular distribution due to their curvature in shape.

15. The lighting system of claim 9, wherein areas of reflective side faces, which are associated with neighboring affected direct light providing areas, are oriented differently with respect to the local light beam directions, thereby reflecting main light rays of the associated affected direct light providing areas into differing directions such that reflected main direct light rays from the neighboring affected direct light providing areas exit the appearance affecting optical system in different directions, thereby breaking up the directional light portion into a plurality of beamlets and/or wherein sub-groups of beamlets are characterized by essentially identical propagation directions.

16. The lighting system of claim 1, wherein at least one of:

at least one structural element is configured to have a diffusive property on transmitted light, at least in the material associated with the direct light illuminated surface region and/or its surface, thereby providing for a diffuse transmission, the at least one structural element is configured to have a diffusive property when transmitting light such that an output directed angular luminous intensity distribution of the direct light after the diffusive transmission broadens with respect to an input directed angular luminous intensity distribution, wherein the feature of a local peak, which defines a transmitted local main direction of direct light transmitted through a specific location, is maintained and wherein in particular a material portion associated with the direct light illuminated surface region diffusely transmits light by providing a transmitted luminous intensity in a transmitted local main light beam direction that is greater than a transmitted luminous intensity of a Lambertian transmitter in that transmitted local main light beam direction, and areas of side faces, which are associated with neighboring affected direct light providing areas, are oriented differently with respect to the local light beam directions, thereby transmitting main light rays of the associated affected direct light providing areas into differing directions such that transmitted main direct light rays from the neighboring affected direct light providing areas exit the appearance affecting optical system in different directions, thereby breaking up the directional light portion into a plurality of beamlets and/or wherein sub-groups of beamlets are characterized by essentially identical propagation directions.

17. The lighting system of claim 16, wherein the output directed angular luminous intensity distribution associated with a material portion of the at least one structural element has a full width half maximum that increases with respect to a directed angular luminous intensity distribution prior to transmission by at least 2%, at least 5%, at least 10%, or 100% but increases by 50° or less, 40° or less, or by about 30° or 20°, and/or the output directed angular luminous intensity distribution associated with a material portion of the at least one structural element has a full width half maximum with respect to a plane containing local main direction and the normal to the light exiting surface that is 50° or less, 40° or less, or about 30° or 20°.

18. The lighting system of claim 1, wherein at least one structural element is configured to have a diffusive property in transmission and reflection such that at least a portion of at least 5% or at least 10% of the radiant flux of the directional light portion is diffusely transmitted or reflected and the remaining portion is respectively reflected or transmitted, and/or the small portion is less broadened in its directed angular luminous intensity distribution than the remaining portion, to a full width half maximum of about 10° for the small portion and about 60° for the remaining portion.

19. The lighting system of claim 1, wherein a full width half maximum associated to the directed angular luminous intensity distribution with respect to a containing the local main direction is about or smaller than 20°, about or smaller than 15°, or about or smaller than 10°, and/or a full width half maximum associated to the directed angular luminous intensity distribution varies for at least two orthogonal planes.

20. The lighting system of claim 1, wherein at least one of:

the local main direct direction is constant over the dichroic light exiting surface or varies over the dichroic light exiting surface within an angular range of about or less than 50°, or about or less than 30°, the diffuse angular luminous intensity distributions are essentially identical across the dichroic light exiting surface, or Lambertian-like, and the shape and/or size of the affected direct light providing areas vary across the dichroic light exiting surface, and the shape, the size, the depth range, and/or the position of the associated direct light illuminated surface regions vary accordingly.

21. The lighting system of claim 1, wherein at least one structural element is configured as a planar or curved lamella, and/or the plurality of structural elements is configured as a sequence of lamellae, being identical in size and orientation or varying in size and orientation and/or as a grid structure extending across the dichroic light exiting surface.

22. The lighting system of claim 1, wherein at least one structural element is configured as a hollow tube element, having a circular, oval, or polygonal cross-section and/or extending between the entrance side and exit side, and the plurality of structural elements comprises a regular or arbitrary arrangement of hollow tube elements across the dichroic light exiting surface.

23. The lighting system of claim 1, wherein at least one structural element is configured as a pillar element having a circular, oval, or polygonal cross-section and/or extending between the entrance side and exit side, and/or the plurality of structural elements comprises a regular or arbitrary arrangement of pillar elements across the dichroic light exiting surface, or across the regularly transmitted light, such that the plurality of diffused light passages comprises at least partly portions of a non-simply connected portions, the portions being essentially perceived as individual diffused light passages that are separated by the structural element.

24. The lighting system of claim 1, wherein the plurality of structural elements are configured as a wall structure to form the structural elements, and the wall structure forms regular, identical, and/or at least to some degree arbitrary diffused light passages having circular, oval, and/or polygonal cross-sections.

25. The lighting system of claim 1, wherein the lighting unit further comprises a light source configured to emit light with a directed luminous intensity profile, a collimating and/or folding optics configured to guide the light from the light source, and a diffuser unit configured to be illuminated by the light source, wherein an output side of diffuser unit forms the dichroic light exiting surface of lighting unit.

* * * * *